US006729533B2

(12) United States Patent
Wozniacki

(10) Patent No.: US 6,729,533 B2
(45) Date of Patent: May 4, 2004

(54) RECLOSABLE FOLDED CONTAINER WITH BELLOWS CORNER PANELS

(75) Inventor: Roger Wozniacki, Cumming, GA (US)

(73) Assignee: Fidelity Container Corporation, Elk Grove Village, IL (US)

( * ) Notice: Subject to any disclaimer, the term of this patent is extended or adjusted under 35 U.S.C. 154(b) by 0 days.

(21) Appl. No.: 10/411,489

(22) Filed: Apr. 10, 2003

(65) Prior Publication Data

US 2004/0011861 A1 Jan. 22, 2004

Related U.S. Application Data

(63) Continuation-in-part of application No. 10/200,424, filed on Jul. 22, 2002, now abandoned.

(51) Int. Cl.[7] ..... B65D 5/24; B65D 43/08

(52) U.S. Cl. ..... 229/125.28; 229/125.31; 229/147; 229/149; 229/151; 229/186

(58) Field of Search ..... 229/147, 149, 229/151, 186, 195, 125.28, 125.31

(56) References Cited

U.S. PATENT DOCUMENTS

| | | | | |
|---|---|---|---|---|
| 1,886,879 A | | 11/1932 | Gross | |
| 1,947,199 A | | 2/1934 | Goodnow | |
| 2,319,919 A | * | 5/1943 | Clark | 229/125.31 |
| 2,718,998 A | | 9/1955 | Bemiss | |
| 3,257,065 A | * | 6/1966 | Bowman et al. | 229/186 |
| 3,454,209 A | * | 7/1969 | Persson | 229/186 |
| 3,889,868 A | | 6/1975 | Bruckner et al. | |
| 4,168,028 A | | 9/1979 | McCall | |
| 5,065,939 A | | 11/1991 | Boothe et al. | |
| 5,284,294 A | | 2/1994 | Floyd | |
| 5,297,726 A | | 3/1994 | Detzel | |
| 5,881,949 A | * | 3/1999 | Focke | 229/125.31 |
| 5,954,263 A | * | 9/1999 | Posson | 229/186 |

FOREIGN PATENT DOCUMENTS

| | | |
|---|---|---|
| FR | 2639615 | 6/1990 |

* cited by examiner

*Primary Examiner*—Gary E. Elkins
(74) *Attorney, Agent, or Firm*—Trexler, Bushnell, Giangiorgi, Blackstone & Marr, Ltd.

(57) ABSTRACT

A reclosable container made of a material, such as paperboard, has a locking corner in the form of a two-section bellows panel that V-folds to form a slot between two rounded edges, free of any cut or raw edges. A closure panel folds over an upper edge of the container. Locking tabs at opposite ends of the closure panel fit into the slots. The rounded edges enable multiple openings and closings of the container without damage to either the slot or the locking tab.

31 Claims, 14 Drawing Sheets

RECLOSABLE FOLDED CONTAINER WITH BELLOWS CORNER PANELS

CROSS-REFERENCE

This application is a Continuation-in-Part of Ser. No. 10/200,424, entitled "Re-closure Folded Paperboard Containers With Bellows Corners" and filed Jul. 22, 2002, abandoned.

BACKGROUND OF THE INVENTION

This invention is directed to reclosable containers constructed of paperboard, plastic or the like, which are designed to enable multiple openings and reclosures. More particularly, the invention is directed to such reclosable containers using significantly less material than reclosable containers of the prior art, which are significantly easier to construct and use, yet which are just as sturdy as the reclosable containers of the prior art.

Containers which are designed to enable multiple openings and reclosures are manufactured by the millions every single year in connection with the packaging of a variety of items, such as poultry, meat, office supplies, and computer products. These containers, however, suffer from a number of disadvantages.

One example of a disadvantage associated with prior art reclosable containers is that the reclosable containers require a number of folds and tabs that must be manipulated to erect, open and/or reclose the container as these types of containers are primarily self-locking, i.e., no adhesives are utilized in the formation of the reclosable containers. These folds and tabs require significant amounts of material, such as corrugated paperboard, to form the blanks and, in the process of constructing same, cause a significant amount of wasted material as well.

For example, attention is directed to U.S. Pat. Nos. 5,065,939 and 5,284,294. Each of these patents discloses a reclosable container which is formed of corrugated paperboard. Rectangular sections of the corrugated paperboard are cut and/or scored to form blanks having a number of folds and/or tabs which can then be folded and manipulated to form the reclosable containers. As illustrated in FIG. 3 of both U.S. Pat. No. 5,065,939 and U.S. Pat. No. 5,284,294, the blank utilizes a significant amount of corrugated paperboard to form the reclosable containers. Further, the blanks also do not utilize a significant amount of the corrugated paperboard from the rectangular sections, such that this material is then wasted. The amount of material wasted increases as the depth of the reclosable container is increased. Thus, the formation of such reclosable containers costs the manufacturer of the reclosable containers a predetermined amount of money both in the amount of material used to form each blank, as well as in the amount of material wasted in the formation of each blank. When it is realized that this predetermined amount of money is multiplied millions of times over with the formation of each blank, as millions of these reclosable containers are manufactured each year, the costs to the manufacturer can grow quite large. Other examples of these types of reclosable containers are illustrated in U.S. Pat. Nos. 3,889,868 and 4,168,028.

Because these reclosable containers do not primarily use adhesives in the formation thereof, the reclosable containers can become less durable and the closure thereof less secure after a number of openings and closings of the container, which is not desirable, especially when many of the reclosable containers must meet certain and sometimes unique industrial standards. For example, containers used for meat and poultry must meet certain sanitary requirements. Office supplies may require reclosable containers for heavy paper, many small items, or the like. Reclosable containers for computer products may have to contain and protect many fragile items. These, and many other varied needs of different industries, will readily occur to those skilled in the art. Thus, if the reclosable containers become less durable and the closure thereof is less secure than is desired or required, the reclosable containers would have to be thrown away and/or recycled, requiring the users of the reclosable containers to utilize more and more of these reclosable containers.

Some prior art containers, however, do utilize adhesives for forming reclosable containers, but require that the adhesive be placed on both sides of the blank prior to the folding of the blank into the reclosable container. As adhesive must be placed on both sides of the blank, glue applicator heads must be provided on both sides of the blank and require a significant amount of glue to be applied to each side of the blank. The use of two glue applicator heads adds to the assembly machine's costs in the formation of the blanks.

Further, many reclosable containers which utilize tabs for locking the container closed have raw edges or large openings which come into contact with the locking tabs during the opening and closing of the containers. Upon the openings and closings of the containers, the locking tabs rub against the raw edges such that upon multiple openings and closings, the locking tab can become damaged, making the opening and closing of the container more difficult. Damage to the locking tab can also cause the container to not meet the industrial standards described hereinabove. The raw edges could also potentially cause injury, such as paper cuts, to the person opening and closing the container, if the person acts carelessly in the opening and closing of the container.

Thus, an improved reclosable container is needed which will overcome the problems and disadvantages associated with prior art reclosable containers. The present invention provides such a reclosable container. Features and advantages of the present invention will become apparent upon a reading of the attached specification, in combination with a study of the drawings.

OBJECTS AND SUMMARY OF THE INVENTION

A general object of an embodiment of the present invention is to provide a blank for a reclosable container which utilizes a minimal amount of material.

An object of an embodiment of the invention is to provide a blank for a reclosable container which utilizes material more efficiently than prior art reclosable containers.

Another object of an embodiment of the invention is to provide a blank for a reclosable container having bellows corner panels having a shoulder formed along an outer edge thereof such that adhesive need only be applied to only one side of the blank.

Another object of an embodiment of the invention is to provide a blank for a reclosable container having bellows corner panels which provide a smooth, unencumbered slot therein for receiving a locking tab to close the container.

Still another object of an embodiment of the invention is to provide a reclosable container having bellows corner panels which are both functional and durable for initial interlocking with a tab member and re-closure thereof.

Yet another object of an embodiment of the invention is to provide a blank for a reclosable container having bellows corner panels and tabs where the tabs are trapped and further secured by the friction created by the opposing sections of the bellows panels.

Another object of an embodiment of the invention is to provide a blank for a reclosable container having bellows corner panels for receiving a tab member for closing the reclosable container where the bellows corner panels defines an opening or slot for receiving the tab which has no raw edges.

Still another object of an embodiment of the invention is to provide a blank for a reclosable container which has a locking corner and tab which is adaptable to many container configurations including one or two-piece, bottom/tray and separate locking lid or cover, containers.

Yet another object of an embodiment of the invention is to provide a blank for a reclosable container which will provide a manufacturer of the reclosable containers with approximately a 10–25% material cost savings in comparison to other reclosable containers of the prior art.

Briefly, and in accordance with the foregoing, the present invention discloses blanks for forming reclosable containers which do not waste as much material as prior art blanks for forming reclosable containers which are easy to construct and use, but which provide the same amount of strength and sturdiness as the prior art blanks for forming reclosable containers.

A first embodiment of a blank for forming reclosable containers provides bellows panels at the corner connection of the front panel to the side panels. When the reclosable container is formed, the bellows panels are bonded to the side panels such that the bellows panels provide slots which have smooth rather than raw or cut edges. The blank further has locking tabs which, when the reclosable container is formed, are capable of slidingly fitting into, and being secured by, the slots formed by the bellows panels such that the reclosable container will be securely closed.

A second embodiment of the blank is provided which is similar to the first embodiment, but also adds first and second internal flaps which abut against the side panels of the reclosable container upon closure thereof to provide further stability to the reclosable container. The addition of the first and second internal flaps, however, does not provide for any further wasted material but actually reduces the amount of wasted material.

A third embodiment of the blank for forming reclosable containers provides bellows panels at the corner connection of the front panel to the side panels. When the reclosable container is formed, the bellows panels are bonded to the front panel such that the bellows panels provide slots which have smooth rather than raw or cut edges. The blank further has locking tabs which, when the reclosable container is formed, are capable of slidingly fitting into, and being secured by, the slots formed by the bellows panels such that the reclosable container will be securely closed.

A fourth embodiment describes blanks used for forming a two-piece reclosable container in which one of the blanks has bellows panels at the corner connection of the front panel to the side panels as well as at the corner connection of the rear panel to the side panels. When the reclosable container is formed, the bellows panels are bonded to the side panels such that the bellows panels provide slots which have smooth rather than raw or cut edges. The other blank forms a top or lid for the reclosable container and has locking tabs which, when the reclosable container is formed, are capable of slidingly fitting into, and being secured by, the slots formed by the bellows panels such that the two-piece reclosable container will be securely closed.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
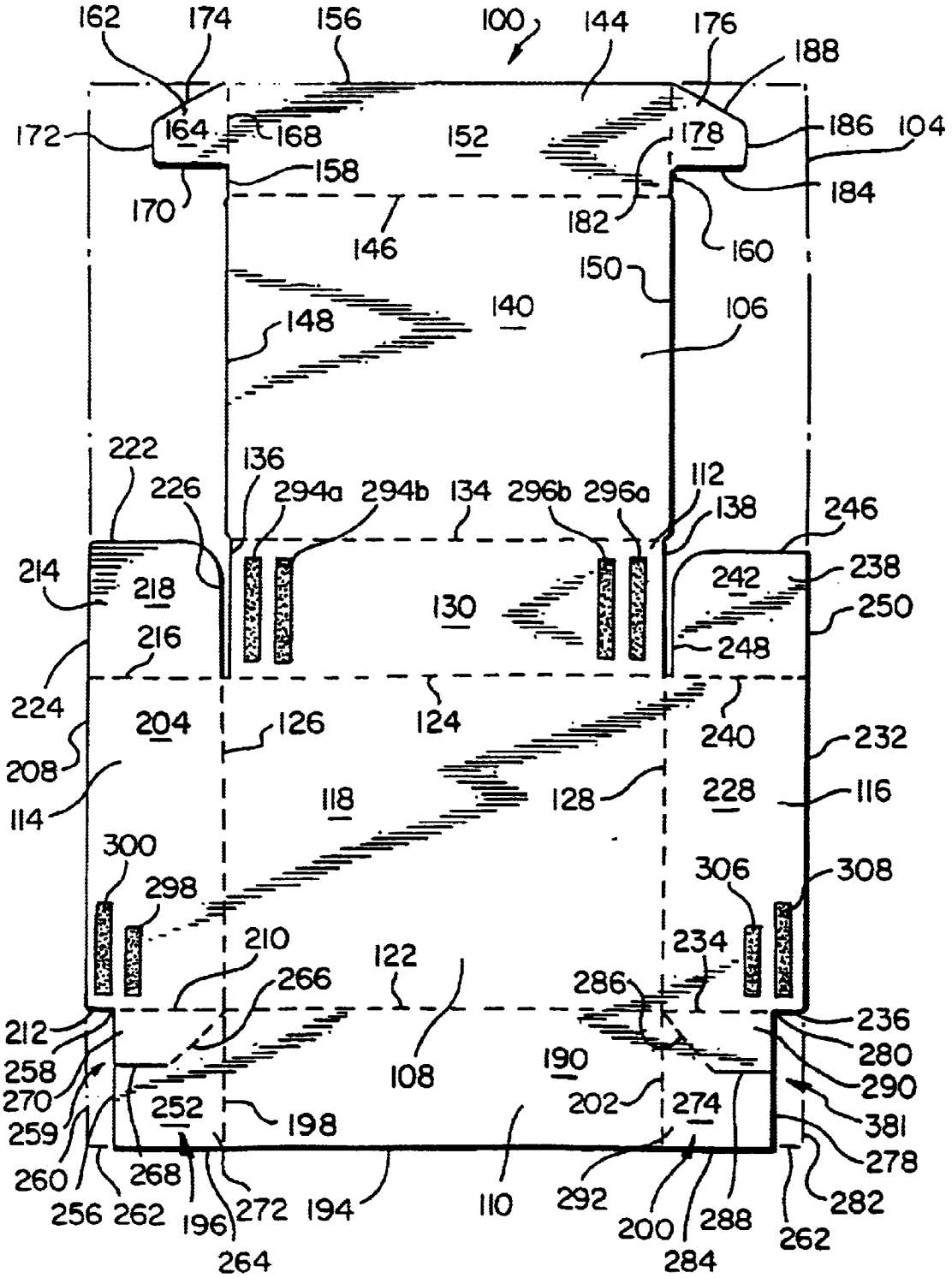
FIG. 1 is a top plan view of a blank in accordance with a first embodiment of the invention which is used to make a reclosable container.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

A first embodiment of a blank 100 used for forming a reclosable container 102 is shown in FIGS. 1–8; a second embodiment of the blank 400 used for forming the reclosable container 402 is shown in FIGS. 9–12; a third embodiment of the blank 700 used for forming the reclosable container 702 is shown in FIGS. 13–18; and a fourth embodiment of the blanks 1000*a*, 1000*b* used for forming the reclosable container 1002 is shown in FIGS. 19–22. Like elements are denoted with like reference numerals with the first embodiment being in the one, two and three hundreds, the second embodiment being in the four, five and six hundreds, the third embodiment being in the seven, eight and nine hundreds, and the fourth embodiment being in the ten, eleven and twelve hundreds.

Figure 2:
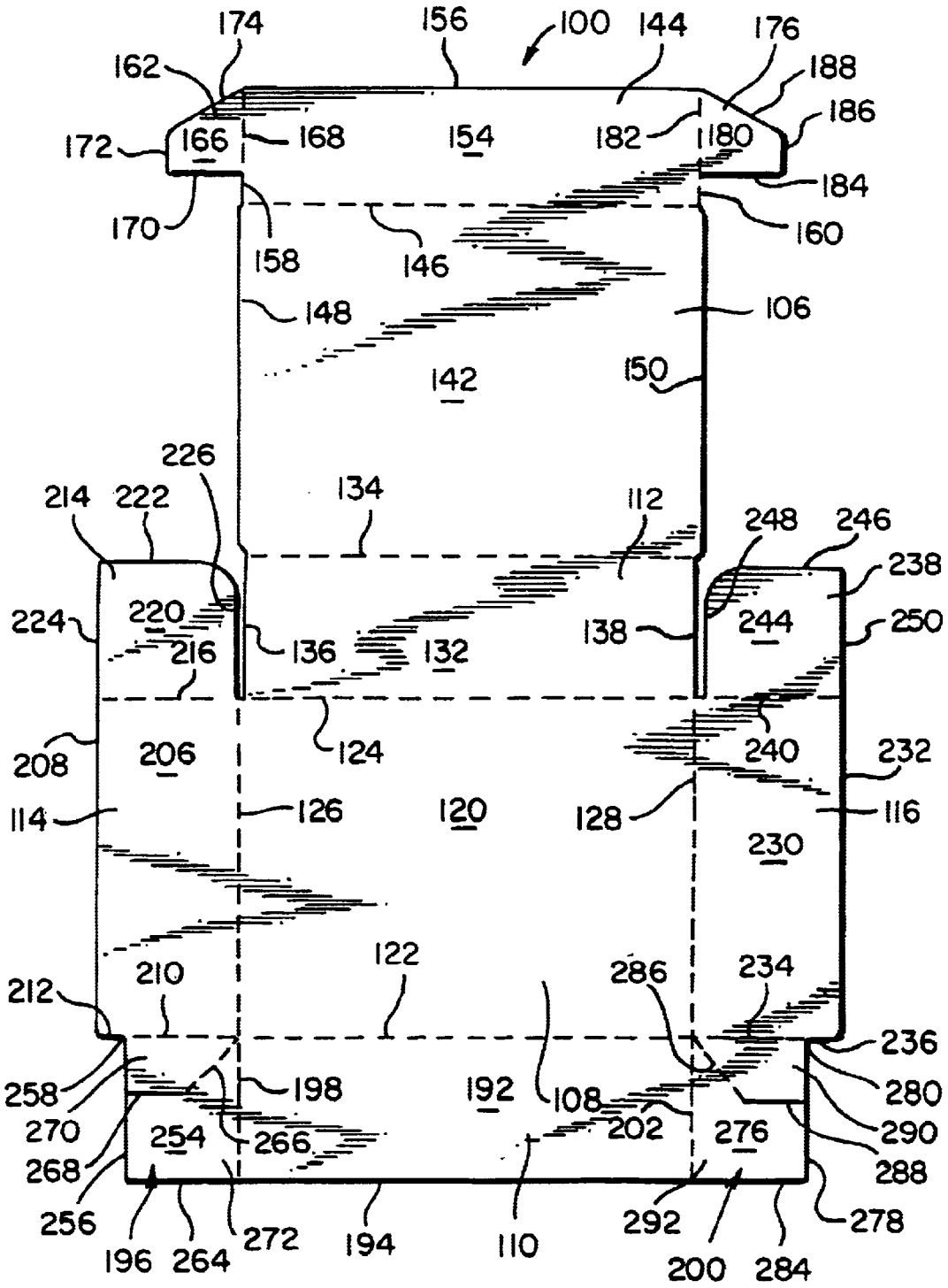
FIG. 2 is a bottom plan view of the blank illustrated in FIG. 1 which is used to make the reclosable container.

Attention is directed to FIGS. 1–8 and the first embodiment of the blank 100 used for forming the reclosable container 102. FIGS. 1 and 2 illustrate the blank 100. The blank 100 is a die cut blank which is cut out of a rectangular piece of material 104, which is illustrated in dashed line. The material 104 from which the blank 100 is die cut is preferably paperboard, but can also be formed of other suitable materials, such as, for example, double-faced corrugated cardboard, plastic, or the like.

The blank 100 is formed to have a plurality of primary panels, namely, a top panel 106, a bottom panel 108, a front panel 110, a rear panel 112, and first and second side panels 114, 116.

The bottom panel 108 is preferably of a rectangular configuration and has a top surface 118, illustrated in FIG. 1, and a bottom surface 120, illustrated in FIG. 2. The bottom panel 108 is connected to the front panel 110 along fold line 122. All fold lines discussed herein with regard to the first embodiment of the blank 100 are illustrated as dashed lines in FIGS. 1 and 2. The bottom panel 108 is connected to the rear panel 112 along fold line 124. Fold lines 122 and 124 are parallel to one another and, in a preferred embodiment of the blank 100, a distance from fold line 122 to fold line 124 is nine inches. The bottom panel 108 is connected to the first side panel 114 along fold line 126. The bottom panel 108 is connected to the second side panel 116 along fold line 128. Fold line 126 and fold line 128 are parallel to one another and, in a preferred embodiment of the blank 100, a distance from fold line 126 to fold line 128 is eleven and thirteen-sixteenths inches. It is to be understood that all dimensions of the blank 100 provided herein are for a preferred embodiment of the blank 100 and that other sizes of blanks 100 can be provided for making varying sizes of reclosable containers 102 as desired.

The rear panel 112 is preferably of a rectangular configuration and has a top surface 130, illustrated in FIG. 1, and a bottom surface 132, illustrated in FIG. 2. The rear panel 112 is connected to the bottom panel 108 along fold line 124. The rear panel 112 is connected to the top panel 106 along fold line 134. Fold line 124 and fold line 134 are parallel to one another and, in a preferred embodiment of the blank 100, a distance from fold line 124 to fold line 134 is three and five-eighths inches. The rear panel 112 has a first side edge 136 and a second side edge 138. The first and second side edges 136, 138 are preferably not connected to any other portion of the blank 100. First and second side edges 136, 138 are parallel to one another and, in a preferred embodiment of the blank 100, a distance from first side edge 136 to second side edge 138 is eleven and nine-sixteenths inches such that the first side edge 136 is offset from the fold line 126 by one-eighth of an inch and such that the second side edge 138 is offset from the fold line 128 by one-eighth of an inch.

The top panel 106 is preferably of a rectangular configuration and has a top surface 140, illustrated in FIG. 1, and a bottom surface 142, illustrated in FIG. 2. The top panel 106 is connected to the rear panel 112 along fold line 134. The top panel 106 is connected to a closure flap 144 along fold line 146. Fold line 134 and fold line 146 are parallel to one another and, in a preferred embodiment of the blank 100, a distance from fold line 134 to fold line 146 is nine and one-eighths inches. The top panel 106 has a first side edge 148 and a second side edge 150. The first and second side edges 148, 150 are preferably not connected to any other portion of the blank 100. First and second side edges 148, 150 are parallel to one another and, in a preferred embodiment of the blank 100, a distance from first side edge 148 to second side edge 150 is eleven and fifteen-sixteenths inches such that the first side edge 136 is offset from the first side edge 148 by three-sixteenths of an inch and such that the second side edge 138 is offset from the second side edge 150 by three-sixteenths of an inch.

The closure flap 144 is preferably of a rectangular configuration and has a top surface 152, illustrated in FIG. 1, and a bottom surface 154, illustrated in FIG. 2. The closure flap 144 is connected to the top panel 106 along fold line 146. The closure flap 144 has a top edge 156. Top edge 156 and fold line 146 are parallel to one another and, in a preferred embodiment of the blank 100, a distance from top edge 156 to fold line 146 is two and fifteen-sixteenths inches. The closure flap 144 has first and second side edges 158, 160 which extend from the fold line 146. First and second side edges 158, 160 are parallel to one another and, in a preferred embodiment of the blank 100, a distance from first side edge 158 to second side edge 160 is eleven and thirteen-sixteenths inches such that the first side edge 158 is offset from the first side edge 148 by one-eighth-of an inch and such that the second side edge 160 is offset from the second side edge 150 by one-eighth of an inch.

The closure flap 144 has a first locking tab 162 extending outwardly therefrom which is connected thereto between the first side edge 158 and the top edge 156. First locking tab 162 is preferably of a trapezoidal configuration and has a top surface 164, illustrated in FIG. 1, and a bottom surface 166, illustrated in FIG. 2. Of course, it is to be understood that other geometrical configurations of the first locking tab 162 could also be formed in keeping with the teachings of the present invention. Fold line 168 is provided between first locking tab 162 and closure flap 144 and, as illustrated in FIGS. 1 and 2, appears to be an extension of first side edge 158. First locking tab 162 has a bottom edge 170 which is connected to the first side edge 158, with the connection therebetween preferably being rounded. Bottom edge 170 is preferably parallel to top edge 156. First locking tab 162 has a side edge 172 which extends from the bottom edge 170, with the connection therebetween preferably being rounded. Side edge 172 is preferably parallel to fold line 168. In a preferred embodiment, a distance between side edge 172 and fold line 168 is two inches and side edge 172 extends one and one-sixteenth inches. First locking tab 162 has a top, tapered edge 174 which extends from the side edge 172 to the top edge 156 of the closure tab 144. The connection between the side edge 172 and the top, tapered edge 174 is preferably rounded.

The closure flap 144 has a second locking tab 176 extending outwardly therefrom which is connected thereto between the second side edge 160 and the top edge 156. Second locking tab 176 is preferably of a trapezoidal configuration and has a top surface 178, illustrated in FIG. 1, and a bottom surface 180, illustrated in FIG. 2. Of course, it is to be understood that other geometrical configurations of the second locking tab 176 could also be formed in keeping with the teachings of the present invention. Fold line 182 is provided between second locking tab 176 and closure flap 144 and, as illustrated in FIGS. 1 and 2, appears to be an extension of second side edge 160. Second locking tab 176 has a bottom edge 184 which is connected to the second side edge 160, with the connection therebetween preferably being rounded. Bottom edge 184 is preferably parallel to top edge 156. Second locking tab 176 has a side edge 186 which extends from the bottom edge 184, with the connection therebetween preferably being rounded. Side edge 186 is preferably parallel to fold line 182. In a preferred embodiment, a distance between side edge 186 and fold line 182 is two inches and side edge 186 extends one and one-sixteenth inches. Second locking tab 176 has a top, tapered edge 188 which extends from the side edge 186 to the top edge 156 of the closure tab 144. The connection between the side edge 186 and the top, tapered edge 188 is preferably rounded.

The front panel 110 is preferably of a rectangular configuration and has a top surface 190, illustrated in FIG. 1, and a bottom surface 192, illustrated in FIG. 2. The front panel 110 is connected to the bottom panel 108 along fold line 122. The front panel 110 has a bottom edge 194. Fold line 122 and bottom edge 194 are parallel to one another and, in a preferred embodiment of the blank 100, a distance from fold line 122 to bottom edge 194 is three and five-eighths inches. The front panel 110 is connected to a bellows panel 196 along fold line 198. The front panel 110 is connected to a bellows panel 200 along fold line 202. Fold line 198 and fold line 202 are parallel to one another and, in a preferred embodiment of the blank 100, a distance from fold line 198 to fold line 202 is eleven and nine-sixteenths inches such that the fold line 198 is offset from the fold line 126 by one-eighth of an inch and such that fold line 202 is offset from the fold line 128 by one-eighth of an inch.

The first side panel 114 is preferably of a rectangular configuration and has a top surface 204, illustrated in FIG. 1, and a bottom surface 206, illustrated in FIG. 2. The first side panel 114 is connected to the bottom panel 108 along fold line 126. The first side panel 114 has a side edge 208. Fold line 126 and side edge 208 are parallel to one another and, in a preferred embodiment of the blank 100, a distance from fold line 126 to side edge 208 is three and nine-sixteenths inches. The first side panel 114 is connected to the bellows panel 196 along fold line 210. Fold line 210 extends from fold line 126 toward side edge 208 a distance of two and fifteen-sixteenths inches such that fold line 210 does not extend to the side edge 208 such that a bottom edge 212 of the first side panel 114 is provided. The connection between the side edge 208 and the bottom edge 212 is preferably rounded. The first side panel 114 is connected to a support flap 214 along fold line 216. Fold line 210 and fold line 216 are parallel to one another and, in a preferred embodiment of the blank 100, a distance from fold line 210 to fold line 216 is eight and seven-eighths inches such that the fold line 216 is offset from the fold line 124 by one-eighth of an inch.

The support flap 214 has a top surface 218, illustrated in FIG. 1, and a bottom surface 220, illustrated in FIG. 2. The support flap 214 has a top edge 222. Fold line 216 and top edge 222 are parallel to one another and, in a preferred embodiment of the blank 100, a distance from fold line 216 to top edge 222 is three and one-half inches. The support flap 214 has a first side edge 224 which, as illustrated in FIG. 1, appears to be an extension of side edge 208. The support flap 214 has a second side edge 226 which is parallel to side edge 136 and is separated therefrom, preferably by one-fourth of an inch, such that second side edge 226 is offset from fold line 126 by one-eighth of an inch. First side edge 224 and second side edge 226 are parallel to one another and, in a preferred embodiment of the blank 100, a distance from first side edge 224 to second side edge 226 is three and seven-sixteenths inches. The connection between the second side edge 226 and the top edge 222 is preferably rounded.

The second side panel 116 is preferably of a rectangular configuration and has a top surface 228, illustrated in FIG. 1, and a bottom surface 230, illustrated in FIG. 2. The second side panel 116 is connected to the bottom panel 108 along fold line 128. The second side panel 116 has a side edge 232. Fold line 128 and side edge 232 are parallel to one another and, in a preferred embodiment of the blank 100, a distance from fold line 128 to side edge 232 is three and nine-sixteenths inches. The second side panel 116 is connected to the bellows panel 200 along fold line 234. Fold line 234 extends from fold line 128 toward side edge 232 a distance of two and fifteen-sixteenths inches such that fold line 234 does not extend to the side edge 232 such that a bottom edge 236 of the second side panel 116 is provided. The connection between the side edge 232 and the bottom edge 236 is preferably rounded. The second side panel 116 is connected to a support flap 238 along fold line 240. Fold line 234 and fold line 240 are parallel to one another and, in a preferred embodiment of the blank 100, a distance from fold line 234 to fold line 240 is eight and seven-eighths inches such that the fold line 240 is offset from the fold line 124 by one-eighth of an inch.

The support flap 238 has a top surface 242, illustrated in FIG. 1, and a bottom surface 244, illustrated in FIG. 2. The support flap 238 has a top edge 246. Fold line 240 and top edge 246 are parallel to one another and, in a preferred embodiment of the blank 100, a distance from fold line 240 to top edge 246 is three and one-half inches. The support flap 238 has a first side edge 248 which is parallel to side edge 138 and is separated therefrom, preferably by one-fourth of an inch, such that first side edge 248 is offset from fold line 128 by one-eighth of an inch. The support flap 238 has a second side edge 250 which, as illustrated in FIG. 1, appears to be an extension of side edge 232. First side edge 248 and second side edge 250 are parallel to one another and, in a preferred embodiment of the blank 100, a distance from first side edge 248 to second side edge 250 is three and seven-sixteenths inches. The connection between the first side edge 248 and the top edge 246 is preferably rounded.

The bellows panel 196 has a top surface 252, illustrated in FIG. 1, and a bottom surface 254, illustrated in FIG. 2. The bellows panel 196 is connected to the front panel 110 along fold line 198. The bellows panel 196 has a side edge 256. Fold line 198 and side edge 256 are parallel to one another and, in a preferred embodiment of the blank 100, a distance from the fold line 198 to the side edge 256 is two and fifteen-sixteenths inches. As the side edge 256 does not extend to the side edge 208, a shoulder 258 is defined by bottom edge 212 and side edge 256. Thus, it is to be understood that a corner or relief portion 259 is bounded by the bottom edge 212 and the side edge 256 which defines the shoulder 258, a side edge 260 of the material 104, and a bottom edge 242 of the material 104, as illustrated in FIG. 1. The purpose for cutting the blank 100 from the material 104 in such a manner will be explained herein in connection with forming the blank 100 into the reclosable container 102. The bellows panel 196 has a bottom edge 264. The bottom edge 264 and the fold line 210 are parallel to one another and, in a preferred embodiment of the blank 100 a distance from the bottom edge 264 to the fold line 210 is three and five-eighth inches.

From the junction of the fold line 122, the fold line 198, and the fold line 210, a fold line 266 is provided which extends onto the bellows panel 196 at an angle, preferably forty-five degrees. A cut line 268 extends from the fold line 266 to the side edge 256. The cut line 268 and the fold line 210 are parallel to one another and, in a preferred embodiment of the blank 100, a distance from the cut line 268 to the fold line 210 is one and one-half inches. The fold line 266 and the cut line 268 separate the bellows panel 196 into a first bellows section 270 and a second bellows section 272. The first bellows section 270 is bounded by fold line 210, fold line 266, cut line 268 and side edge 256. The second bellows section 272 is bounded by fold line 198, bottom edge 264, side edge 256, cut line 268 and fold line 266.

The bellows panel 200 has a top surface 274, illustrated in FIG. 1, and a bottom surface 276, illustrated in FIG. 2. The bellows panel 200 is connected to the front panel 110 along fold line 202. The bellows panel 200 has a side edge 278. Fold line 202 and side edge 278 are parallel to one another and, in a preferred embodiment of the blank 100, a distance from the fold line 202 to the side edge 278 is two and fifteen-sixteenths inches. As the side edge 278 does not extend to the side edge 232 a shoulder 280 is defined by the bottom edge 236 and side edge 278. Thus, it is to be understood that a corner or relief portion 281 of the material 104 is not included in the blank 100 and that the relief portion 281 is bounded by the bottom edge 236 and the side edge 278 which define the shoulder 280, a side edge 282 of the material 104, and the bottom edge 242 of the material, as illustrated in FIG. 1. The purpose for cutting the blank 100 in such a manner will be explained herein in connection with forming the blank 100 into the reclosable container 102. The bellows panel 200 has a bottom edge 284. The bottom edge 284 and the fold line 234 are parallel to one another and, in a preferred embodiment of the blank 100 a distance from the bottom edge 284 to the fold line 234 is three and five-eighth inches.

From the junction of the fold line 122, the fold line 202, and the fold line 234, a fold line 286 is provided which extends onto the bellows panel 200 at an angle, preferably forty-five degrees. A cut line 288 extends from the fold line 286 to the side edge 278. The cut line 288 and the fold line 234 are parallel to one another and, in a preferred embodiment of the blank 100, a distance from the cut line 288 to the fold line 234 is one and one-half inches. The fold line 286 and the cut line 288 separate the bellows panel 200 into a first bellows section 290 and a second bellows section 292. The first bellows section 290 is bounded by fold line 234, fold line 286, cut line 288 and side edge 278. The second bellows section 292 is bounded by fold line 202, bottom edge 284, side edge 278, cut line 288 and fold line 286.

Adhesives, such as glue, are also preferably applied to the blank 100 by a glue applicator head for the formation of the reclosable container 102, as will be discussed further herein. First and second adhesive portions 294*a*, 294*b* are applied to the rear panel 112 on the top surface 230 thereof proximate and parallel to the first side edge 136. The first and second adhesive portions 294*a*, 294*b* are used for securing the support flap 214 to the rear panel 112 as will be discussed further herein. Third and fourth adhesive portions 296*a*, 296*b* are applied to the rear panel 112 on the top surface 230 thereof proximate and parallel to the second side edge 138. The third and fourth adhesive portions 296*a*, 296*b* are used for securing the support flap 238 to the rear panel 112 as will be discussed further herein. A fifth adhesive portion 298 is applied to the first side panel 114 on the top surface 204 thereof proximate to the fold line 210 and parallel to the side edge 208. The fifth adhesive portion 298 is used for securing the first bellows section 270 of the bellows panel 196 to the first side panel 114. A sixth adhesive portion 300 is applied to the first side panel 114 on the top surface 204 thereof proximate to the junction of the side edge 208 and the bottom edge 212 and is parallel to the side edge 208 such that the sixth adhesive portion 300 is provided between the fifth adhesive portion 298 and the side edge 208. The sixth adhesive portion 300 is used for securing the second bellows section 272 of the bellows panel 196 to the first side panel 114. A seventh adhesive portion 306 is applied to the second side panel 116 on the top surface 228 thereof proximate to the fold line 234 and parallel to the side edge 232. The seventh adhesive portion 306 is used for securing the first bellows section 290 of the bellows panel 200 to the second side panel 116. An eighth adhesive portion 308 is applied to the second side panel 116 on the top surface 228 thereof proximate to the junction of the side edge 232 and the bottom edge 236 and is parallel to the side edge 232 such that the eighth adhesive portion 308 is provided between the seventh adhesive portion 306 and the side edge 232. The eighth adhesive portion 308 is used for securing the second bellows section 292 of the bellows panel 200 to the second side panel 116. Each of the adhesives preferably has a width of three-sixteenths inches.

The method of forming the reclosable container 102 using the blank 100 as described will now be discussed and attention is directed to FIGS. 3–8.

Figure 3:
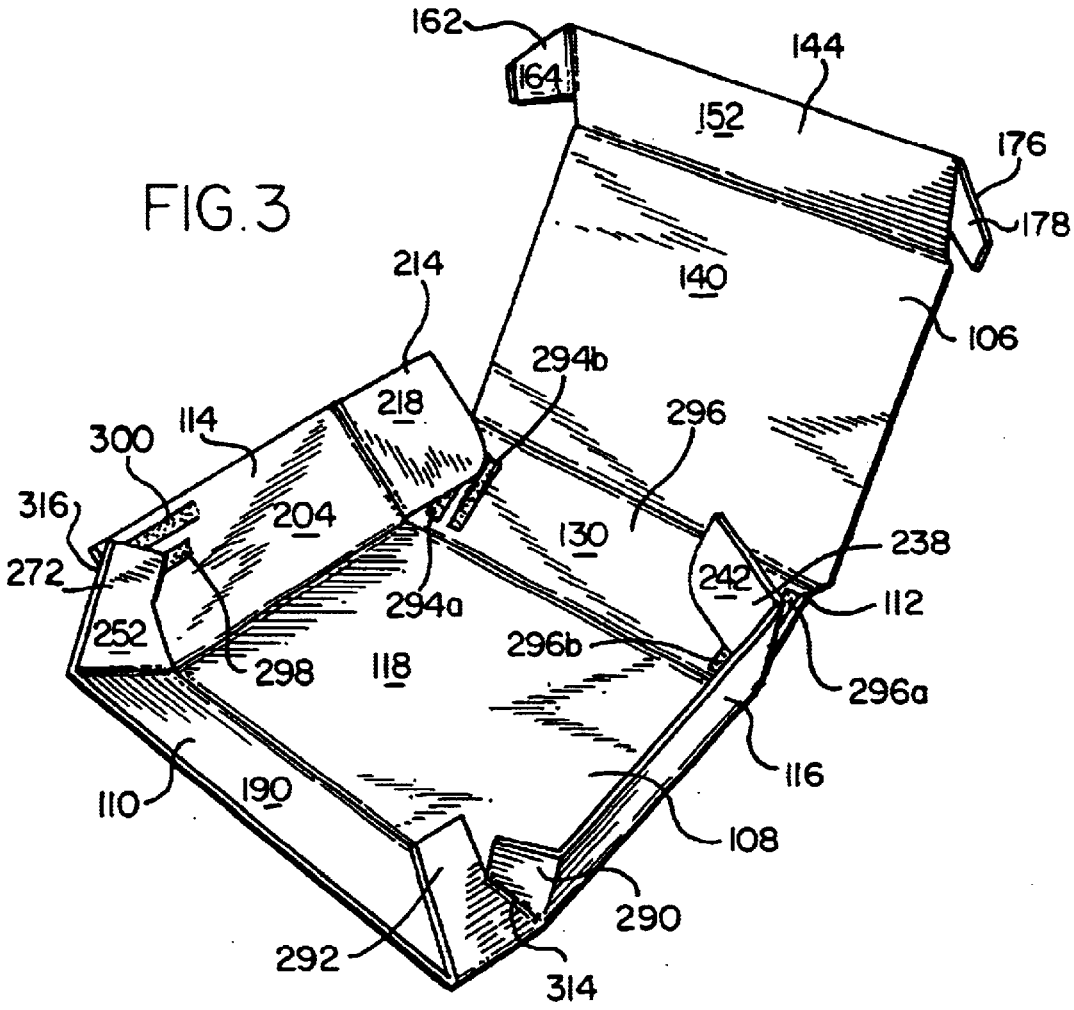
FIG. 3 is a perspective view of the blank illustrated in FIG. 1 being erected to form the reclosable container.
Figure 4:
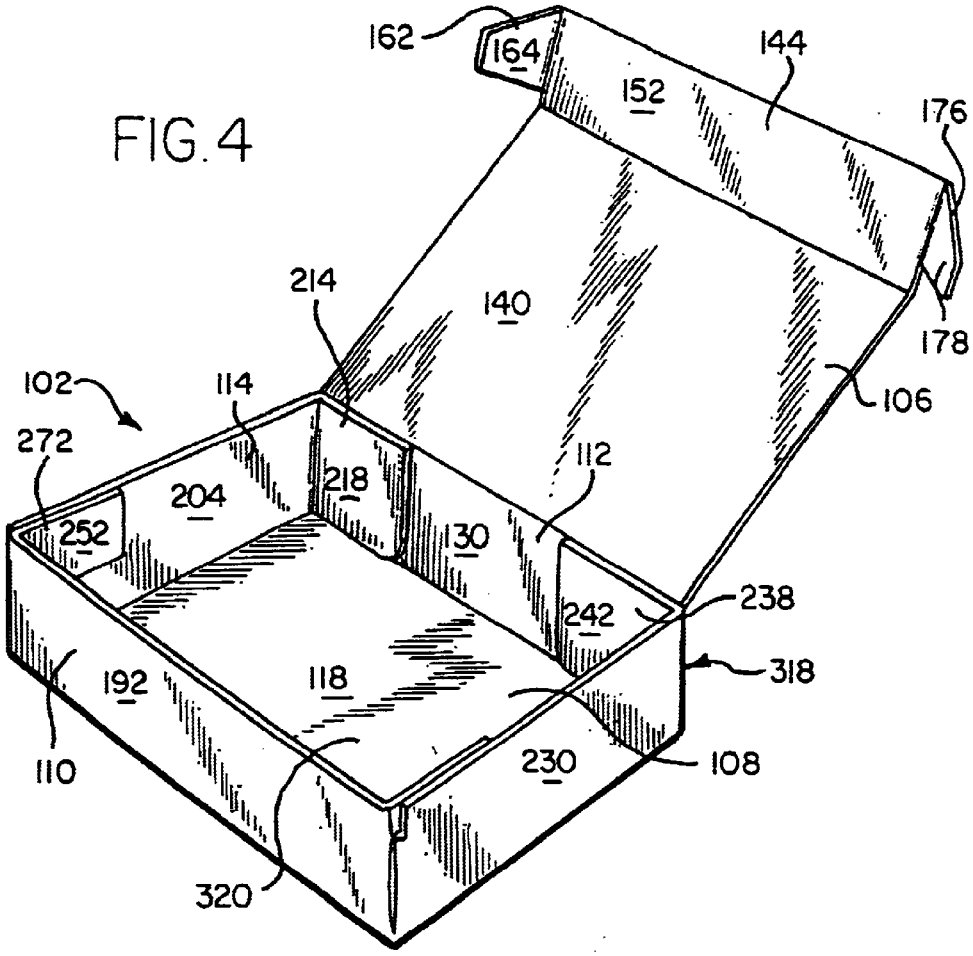
FIG. 4 is a perspective view of the reclosable container erected from the blank illustrated in FIG. 1 with the top or lid of the reclosable container being in an open position.
Figure 4A:
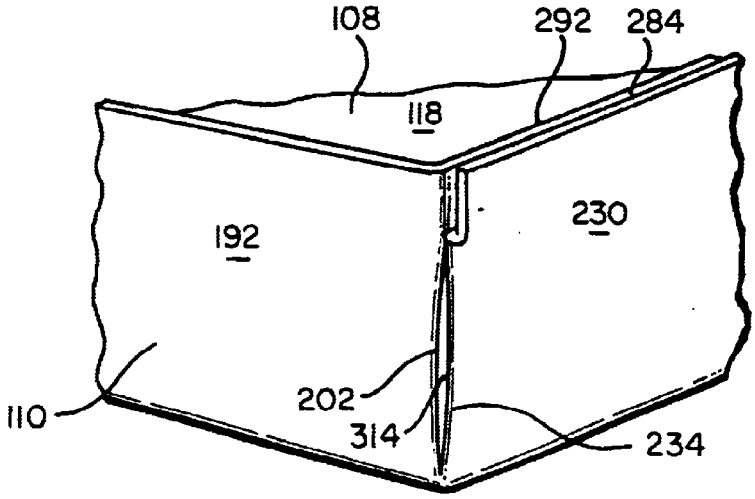
FIG. 4A is an enlarged perspective view of a portion of the reclosable container illustrated in FIG. 4 illustrating the bellows corner panel being bonded to a sidewall of the reclosable container such that a slot is formed by the bellows corner panel.

With reference to FIGS. 3–4A, the front panel 110 is folded upwardly from the bottom panel 108 along fold line 122; the rear panel 112 is folded upwardly from the bottom panel 108 along fold line 124; the first side panel 114 is folded upwardly from the bottom panel 108 along fold line 126; and the second side panel 116 is folded upwardly from the bottom panel 108 along the fold line 128. The folding of the front panel 110, the rear panel 112, the first side panel 114 and the second side panel 116 upwardly from the bottom panel 108 typically occur simultaneously, but it should be understood that the folding of one or more of the panels 110, 112, 114, 116 could be performed prior to the folding of the other of the panels 110, 112, 114, 116.

As best illustrated in FIG. 3, as the first side panel 114 is folded upwardly from the bottom panel 108 along fold line 126, the support flap 214 is folded inwardly along fold line 216 such that the bottom surface 220 of the support flap 214 faces the top surface 130 of the rear panel 110 and, thus, the first and second adhesive portions 294*a*, 294*b* provided on the top surface 130 of the rear panel 110. Once the rear panel 112 and the first side panel 114 are positioned perpendicular to one another, as well as perpendicular to the bottom panel 108, the bottom surface 220 of the support flap 214 is securely bonded to the top surface 130 of the rear panel 112 by the first and second adhesive portions 294*a*, 294*b*, as illustrated in FIG. 4. Likewise, as the second side panel 116 is folded upwardly from the bottom panel 108 along fold line 128, the support flap 238 is folded inwardly along fold line 240 such that the bottom surface 244 of the support flap 238 faces the top surface 130 of the rear panel 110 and, thus, the third and fourth adhesive portions 296*a*, 296*b* provided on the top surface 130 of the rear panel 110. Once the rear panel 112 and the second side panel 116 are positioned perpendicular to one another, as well as perpendicular to the bottom panel 108, the bottom surface 244 of the support flap 238 is securely bonded to the top surface 130 of the rear panel 112 by the third and fourth adhesive portions 296*a*, 296*b*, as illustrated in FIG. 4. The folding of the support flap 214 and the support flap 238 inwardly typically occur simultaneously, but it should be understood that the folding of one of the support flaps 214, 238 could be performed prior to the folding of the other of the support flaps 214, 238.

Figure 3A:
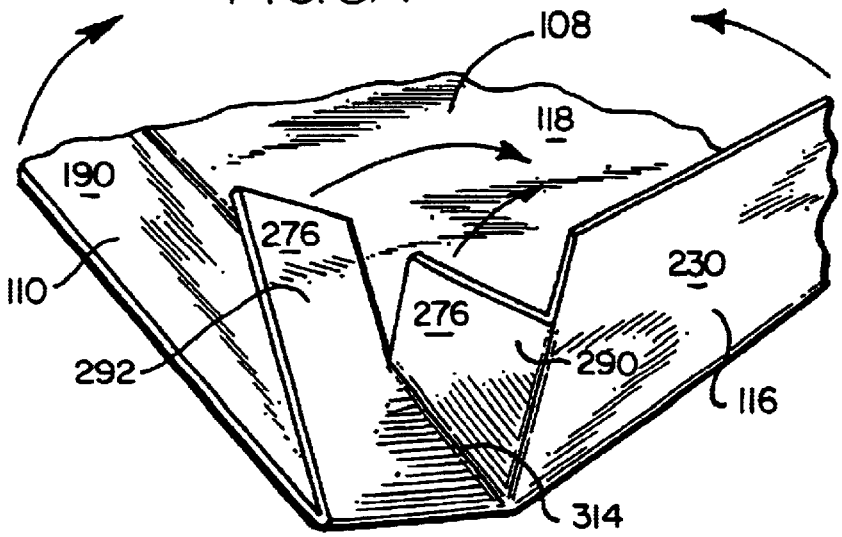
FIG. 3A is an enlarged perspective view of a portion of the blank illustrated in FIG. 3 illustrating a bellows corner panel in a condition preparatory to bonding.

As best illustrated in FIG. 3A, as the front panel 110 and the second side panel 116 are folded upwardly from the bottom panel 108, the bellows panel 200 is folded inwardly along fold lines 202, 234. The bellows panel 200 is also V-folded along fold line 286. The folding of the bellows panel 200 along fold lines 202, 234, 286 provides that the top surface 274 of the first bellows section 290 faces the top surface 228 of the second side panel 116 and, thus, the seventh adhesive portion 306 provided on the top surface 228 of the second side panel 116. The folding of the bellows panel 200 along fold lines 202, 234, 286 further provides that the bottom surface 276 of the second bellows section 292 faces the top surface 228 of the second side panel 116 and, thus, the seventh and eighth adhesive portions 306, 308 provided on the top surface 228 of the second side panel 116. The bottom surface 276 of the second bellows section 292 is allowed to face the eighth adhesive portion 308 proximate to the bottom edge 236 because the blank 100 was cut from the material 104 such that the relief portion 281 was not included as part of the bellows panel 200 of the blank 100. As the blank 100 is cut from the material 104 and does not include the relief portion 281, the adhesives used for forming the reclosable container 102 need only be applied to one-side of the blank 100, such that two complete applicator heads are not necessary. The bottom surface 276 of the second bellows section 292 also faces the bottom surface 276 of the first bellows section 290 as the two bellows sections 290, 292 V-fold along the fold line 286 such that a slot or aperture 314 is formed between the bottom surface 276 of the second bellows section 292 and the bottom surface 276 of the first bellows section 290.

Once the front panel 112 and the second side panel 116 are perpendicular to one another, as well as perpendicular to the bottom panel 108, the top surface 274 of the first bellows section 290 is bonded to the top surface 228 of the second side panel 116 by the seventh adhesive portion 306, as illustrated in FIG. 4, and the bottom surface 276 of the second bellows section 292 is bonded to the top surface 228 of the second side panel 116 by the seventh and eighth adhesive portions 306, 308. A portion of the bottom surface 276 of the second bellows section 292 is not bonded to the top surface 228 of the second side panel 116, but rather faces the bottom surface 276 of the first bellows section 290 such that the slot 314 is provided therebetween.

One side of an opening to the slot 314 is provided at the fold line 202 while the other side of the opening to the slot 314 is provided at the fold line 234 such that the sides of the opening to the slot 314 are smooth and rounded. Thus, as best illustrated in FIG. 4A, the opening to the slot 314 is bounded by smooth edges with no raw or cut edges.

Similarly, as the front panel 110 and the first side panel 114 are folded upwardly from the bottom panel 108, the bellows panel 196 is folded inwardly along fold lines 198, 210. The bellows panel 196 is also V-folded along fold line 266. The folding of the bellows panel 196 along fold lines 198, 210, 266 provides that the top surface 252 of the first bellows section 270 faces the top surface 204 of the first side panel 114 and, thus, the fifth adhesive portion 298 provided on the top surface 204 of the first side panel 114. The folding of the bellows panel 196 along fold lines 198, 210, 266 further provides that the bottom surface 254 of the second bellows section 272 faces the top surface 204 of the first side panel 114 and, thus, the fifth and sixth adhesive portions 298, 300 provided on the top surface 204 of the first side panel 114. The bottom surface 254 of the second bellows section 272 is allowed to face the sixth adhesive portion 300 proximate to the bottom edge 212 because the blank 100 was cut from the material 104 such that the relief portion 259 was not included as part of the bellows panel 196 of the blank 100. As the blank 100 is cut from the material 104 and does not include the relief portion 259, the adhesives used for forming the reclosable container 102 need only be applied to one-side of the blank 100, such that two complete applicator heads are not necessary. The bottom surface 254 of the second bellows section 272 also faces the bottom surface 254 of the first bellows section 270 as the two bellows sections 270, 272 V-fold along the fold line 266 such that a slot or aperture 316 is formed between the bottom surface 254 of the second bellows section 272 and the bottom surface 254 of the first bellows section 270.

Once the front panel 110 and the first side panel 114 are perpendicular to one another, as well as perpendicular to the bottom panel 108, the top surface 252 of the first bellows section 270 is bonded to the top surface 204 of the first side panel 114 by the fifth adhesive portion 298, as illustrated in FIG. 4, and the bottom surface 254 of the second bellows section 272 is bonded to the top surface 204 of the first side panel 114 by the fifth and sixth adhesive portions 298, 300. A portion of the bottom surface 254 of the second bellows section 272 is not bonded to the top surface 204 of the first side panel 114, but rather faces the bottom surface 254 of the first bellows section 270 such that the slot 316 is provided therebetween.

One side of an opening to the slot 316 is provided at the fold line 198 while the other side of the opening to the slot 316 is provided at the fold line 210 such that the sides of the opening to the slot 316 are smooth and rounded. Thus, the opening of the slot 316 is bounded by smooth edges with no raw or cut edges.

Thus, as best illustrated in FIG. 4, the blank 100 is first formed to provide a base tray portion 318 having the top panel 106 extending therefrom. The base tray portion 318 has an opening 320 configured to receive material to be packed into the reclosable container 102, for instance, meat, poultry, and office supplies. The base tray portion 318 is sturdy and in an upright condition.

Figure 5:
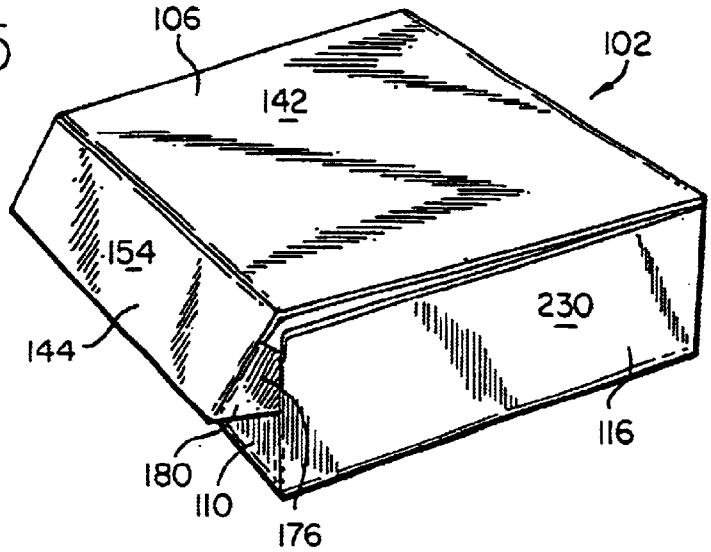
FIG. 5 is a perspective view of the reclosable container erected from the blank illustrated in FIG. 1 with tab portions of the top or lid of the reclosable container being received in the slot formed by the bellows corner panel.

Once the base tray portion 318 is formed, the top panel 106 can be manipulated to securely close off the opening 320. As best illustrated in FIG. 5, the top panel 106 is folded along the fold line 134 such that the top panel 106 moves over the opening 320 of the base tray portion 318 until the top panel 106 is perpendicular to the front panel 110, the rear panel 112, and the first and second side panels 114, 116, and until the top panel 106 is parallel to the bottom panel 108 such that the top surface 140 of the top panel 106 faces the top surface 118 of the bottom panel 108.

The tabs 162, 176 are folded along fold lines 168, 182, respectively such that the tabs 162, 176 are perpendicular to the closure flap 144. The closure flap 144 is then folded along fold line 146, as best illustrated in FIG. 5. As the closure flap 144 is folded along fold line 146, the tab 162 is inserted into slot 316 such that the top surface 164 of tab 162 faces the portion of the bottom surface 254 of the second bellows section 272 which is not bonded to the top surface 204 of the first side panel 114 and the bottom surface 166 of the tab 162 faces the bottom surface 254 of the first bellows section 270. Likewise, as the closure flap 144 is folded along fold line 146, the tab 176 is inserted into slot 314 such that the top surface 178 of tab 176 faces the portion of the bottom surface 276 of the second bellows section 292 which is not bonded to the top surface 228 of the second side panel 116 and the bottom surface 180 of the tab 176 faces the bottom surface 276 of the first bellows section 290.

Figure 6:
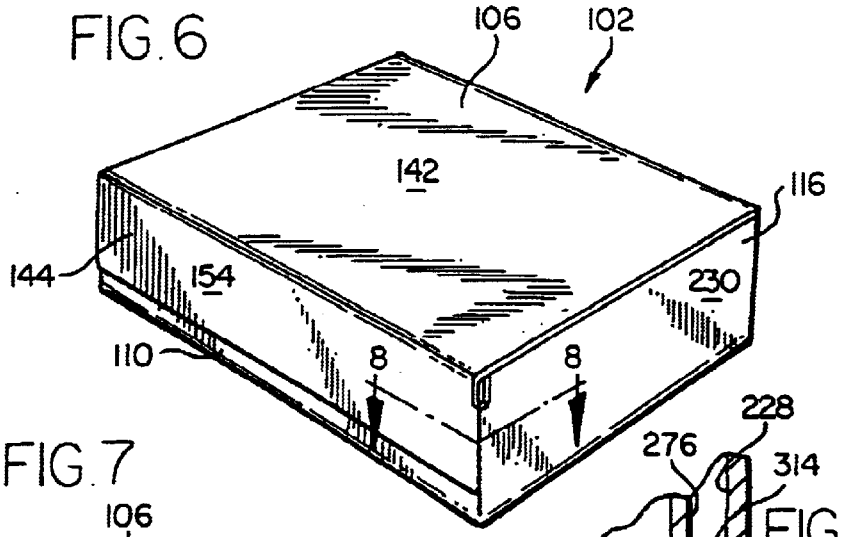
FIG. 6 is a perspective view of the reclosable container erected from the blank illustrated in FIG. 1 with the top or lid of the reclosable container being in a closed position.
Figure 7:
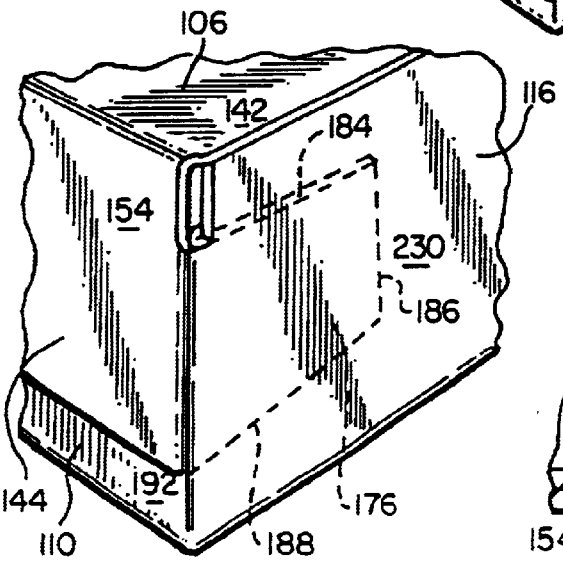
FIG. 7 is an enlarged perspective view of a portion of the reclosable container illustrated in FIG. 6, with a portion of the container cut away, illustrating the tab, in dashed line, inserted into the slot formed by the bellows corner panel.
Figure 8:
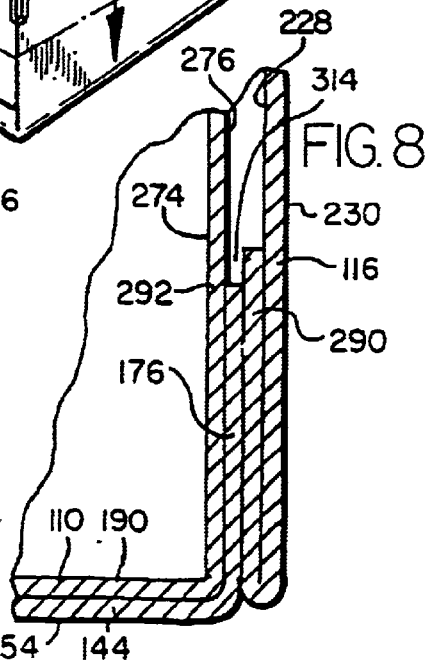
FIG. 8 is a cross-sectional view of the reclosable container taken along line 8—8 of FIG. 6.

The tabs 162, 176 are configured as described herein such that they are inserted into the slots 316, 314, respectively, and underneath the sixth and eighth adhesive portions 300, 306, respectively, until the closure flap 144 is perpendicular to the top panel 106 and the top surface 152 of the closure flap 144 faces the bottom surface 192 of the front panel 110. The slots 316, 314 are sized to accept the tabs 162, 176. The tabs 162, 176 are trapped and further secured within the slots 316, 314, respectively, by friction created by the bellows panels 196, 200, respectively, as the bellows panels 196, 200 effectively "pinch" the tabs 162, 176 within the slots 314, 316, respectively, to secure them therein. The "pinch" is caused by the bottom surface 276 of the second bellows section 292 being bonded to the sixth adhesive portion 300 and by the bottom surface 254 of the second bellows section 272 being bonded to the eighth adhesive portion 308. The reclosable container 102 is thus in a secured, closed position, as illustrated in FIG. 6. FIGS. 7 and 8 illustrate the construction of the reclosable container 102 in the secured, closed position where the tab 176 is inserted into the slot 314.

As the slots 314, 316 do not have any raw or cut edges at the opening thereof, the tabs 176, 162, respectively, can be inserted and removed from the slots 314, 316, in order to open and close the container 102 without the concern of the tabs 162, 176 being damaged or frayed because of repeated contact with raw or cut edges.

It is to be understood that other geometrical configurations of the blank 100 could be formed, such as a pentagon or a hexagon, by changing the configuration of the top and bottom panels 106, 108 and adding side panels and bellows corner panels as necessary.

Attention is directed to FIGS. 9–12 which illustrate the second embodiment of the blank 400 used for forming the reclosable container 402. The blank 400 used for forming the reclosable container 402 is identical to the blank 100 used for forming the reclosable container 102 except that a top panel 406 of the blank 400 differs from the top panel 106 of the blank 100. Thus, the description of the blank 400 used for forming the reclosable container 402 will only discuss the differences between the blank 100 and the blank 400.

Figure 9:
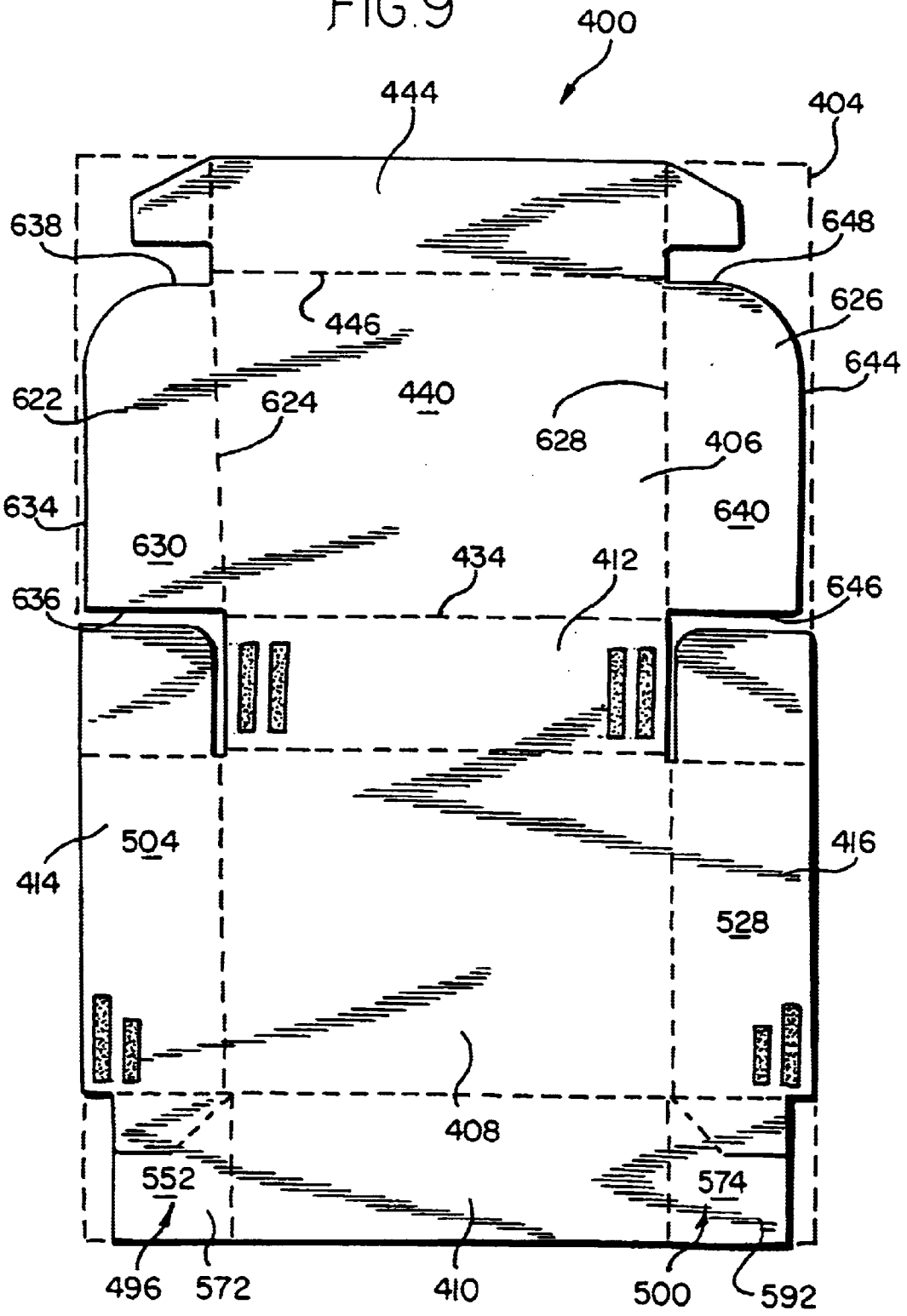
FIG. 9 is a top plan view of a blank in accordance with a second embodiment of the invention which is used to make a reclosable container.
Figure 10:
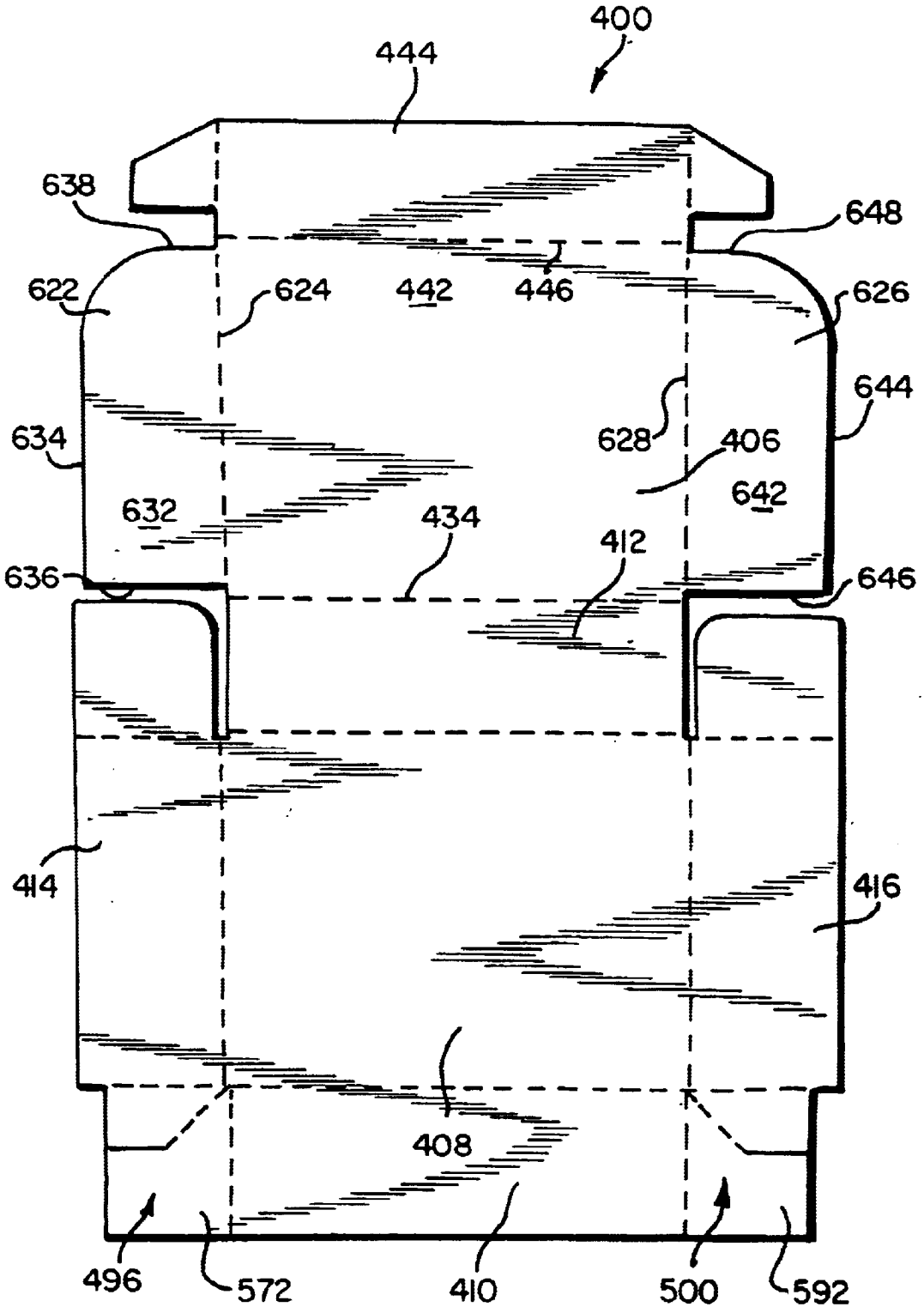
FIG. 10 is a bottom plan view of the blank illustrated in FIG. 9 which is used to make the reclosable container.

The top panel 406 is preferably of a rectangular configuration and has a top surface 440, illustrated in FIG. 9, and a bottom surface 442, illustrated in FIG. 10. The top panel 406 is connected to the rear panel 412 along fold line 434. The top panel 406 is connected to a closure flap 444 along fold line 446. Fold line 434 and fold line 446 are parallel to one another and, in a preferred embodiment of the blank 400, a distance from fold line 434 to fold line 446 is nine and one-eighths inches. The top panel 406 is connected to a first internal flap 622 along fold line 624. The top panel 406 is connected to a second internal flap 626 along fold line 628. Fold line 624 and fold line 628 are parallel to one another and, in a preferred embodiment of the blank 400, a distance from the fold line 624 to the fold line 628 is eleven and nine-sixteenths inches such that the fold line 624 appears to be an extension of fold line 426 and such that the fold line 628 appears to be an extension of fold line 428.

The first internal flap 622 has a top surface 630, illustrated in FIG. 9, and a bottom surface 632, illustrated in FIG. 10. The first internal flap 622 has a side edge 634. Fold line 624 and side edge 634 are parallel to one another and, in a preferred embodiment of the blank 400, a distance from fold line 624 to side edge 634 is three and nine-sixteenths inches. The first internal flap 622 has a bottom edge 636 and a top edge 638. Bottom edge 636 and top edge 638 are parallel to one another and, in a preferred embodiment of the blank 400, a distance from bottom edge 636 to top edge 638 is eight and seven-eighth inches such that the bottom edge 636 is offset one-eighth of an inch from the fold line 434 and such that the top edge 638 is offset one-eighth of an inch from the fold line 446. The connection between the top edge 638 and the side edge 634 is preferably rounded. The side edge 634, the bottom edge 636 and the top edge 638 are preferably not connected to any other portion of the blank 400.

The second internal flap 626 has a top surface 640, illustrated in FIG. 9, and a bottom surface 642, illustrated in FIG. 10. The second internal flap 626 has a side edge 644. Fold line 628 and side edge 644 are parallel to one another and, in a preferred embodiment of the blank 400, a distance from fold line 628 to side edge 644 is three and nine-sixteenths inches. The first internal flap 626 has a bottom edge 646 and a top edge 648. Bottom edge 646 and top edge 648 are parallel to one another and, in a preferred embodiment of the blank 400, a distance from bottom edge 646 to top edge 648 is eight and seven-eighth inches such that the bottom edge 646 is offset one-eighth of an inch from the fold line 434 and such that the top edge 648 is offset one-eighth of an inch from the fold line 446. The connection between the top edge 648 and the side edge 644 is preferably rounded. The side edge 644, the bottom edge 646 and the top edge 648 are preferably not connected to any other portion of the blank 400.

The method of forming the reclosable container 402 using the blank 400 as described will now be discussed and attention is directed to FIGS. 11 and 12. As the blank 400 used for forming the reclosable container 402 is identical to the blank 100 used for forming the reclosable container 102 except that the top panel 406 of the blank 400 differs from the top panel 106 of the blank 100, only the differences between the method of forming the reclosable container 102 and the reclosable container 402 will be discussed herein.

Figure 11:
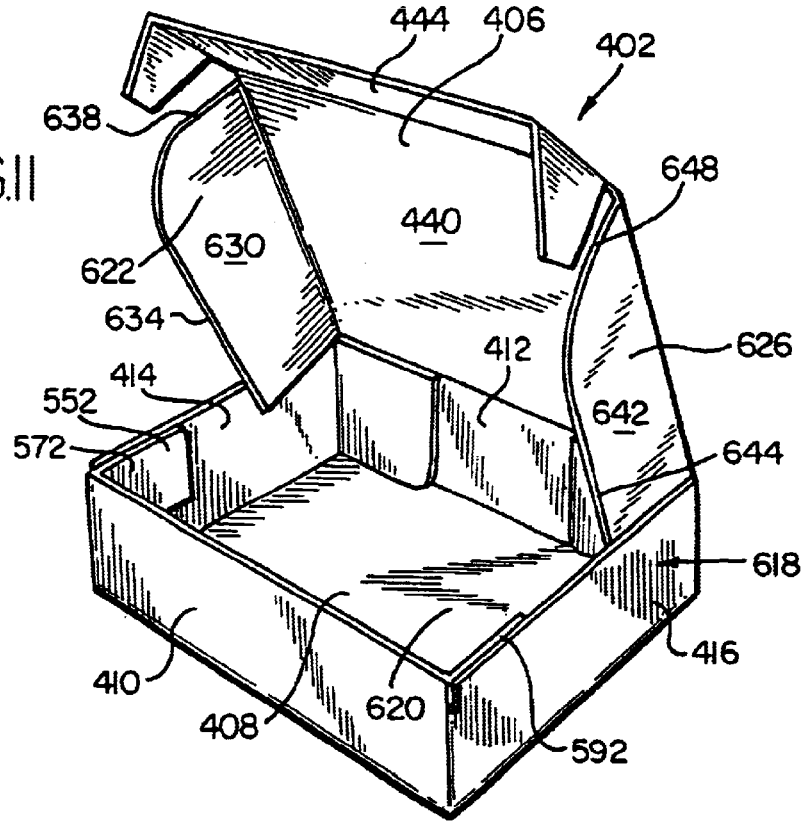
FIG. 11 is a perspective view of the reclosable container erected from the blank illustrated in FIG. 9 with the top or lid of the reclosable container being in an open position.
Figure 12:
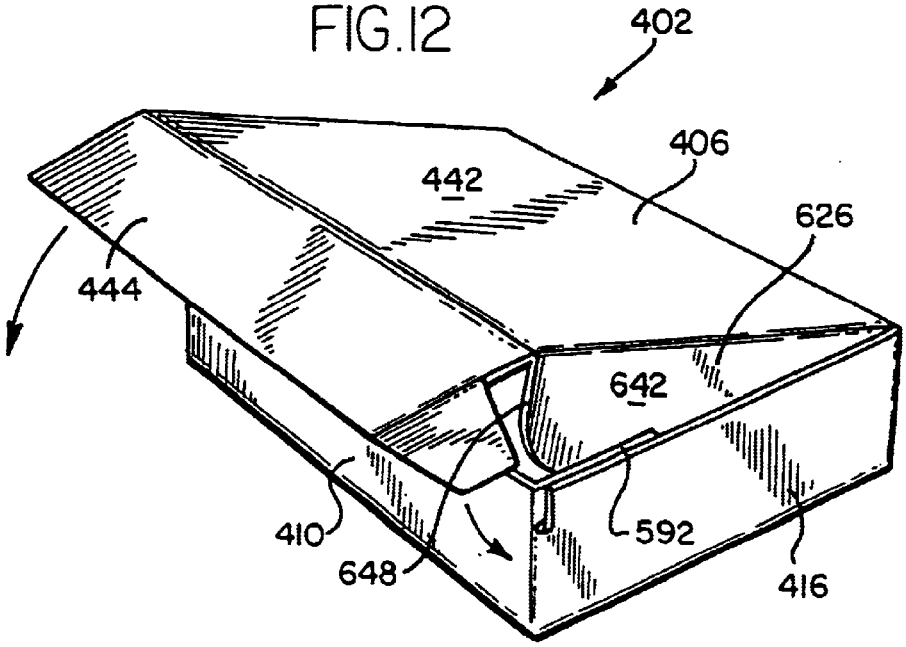
FIG. 12 is a perspective view of the reclosable container erected from the blank illustrated in FIG. 9 with flap portions of the top or lid of the reclosable container being received in the opening of the reclosable container.

As best illustrated in FIG. 11, the blank 400 is first formed to provide a base tray portion 618 having the top panel 406 extending therefrom. The base tray portion 618 has an opening 620 configured to receive material to be packed into the reclosable container 402, for instance, meat, poultry, and office supplies. The base tray portion 618 is sturdy and in an upright condition.

Once the base tray portion 618 is formed, the top panel 406 can be manipulated to securely close off the opening 620. As best illustrated in FIG. 11, the first internal flap 622 is folded along the fold line 624 and the second internal flap 626 is folded along the fold line 628 until the first internal flap 622 and the second internal flap 626 are perpendicular to the top panel 406 and the top surface 630 of the first internal flap 622 faces the top surface 640 of the second internal flap 626. The top panel 406 is folded along fold line 434 such that the top panel 406 moves over the opening 620 of the base tray portion 618.

As the top panel 406 moves over the opening 620 of the base tray portion 618, the first internal flap 622 and the second internal flap 626 are moved into the opening 620 of the base tray portion 618 with the bottom surface 632 of the first internal flap 622 being positioned against the top surface 504 of the first side panel 414 and with the bottom surface 642 of the second internal flap 626 being positioned against the top surface 528 of the second side panel 416. As the top panel 406 moves closer to being parallel to the bottom panel 408 and perpendicular to the front panel 410, the rear panel 412, and the first and second side panels 414, 416, the first internal flap 622 is positioned against the top surface 552 of the second bellows section 572 of the bellows panel 496, and the second internal flap 626 is positioned against the top surface 574 of the second bellows section 592 of the bellows panel 500.

Figure 13:
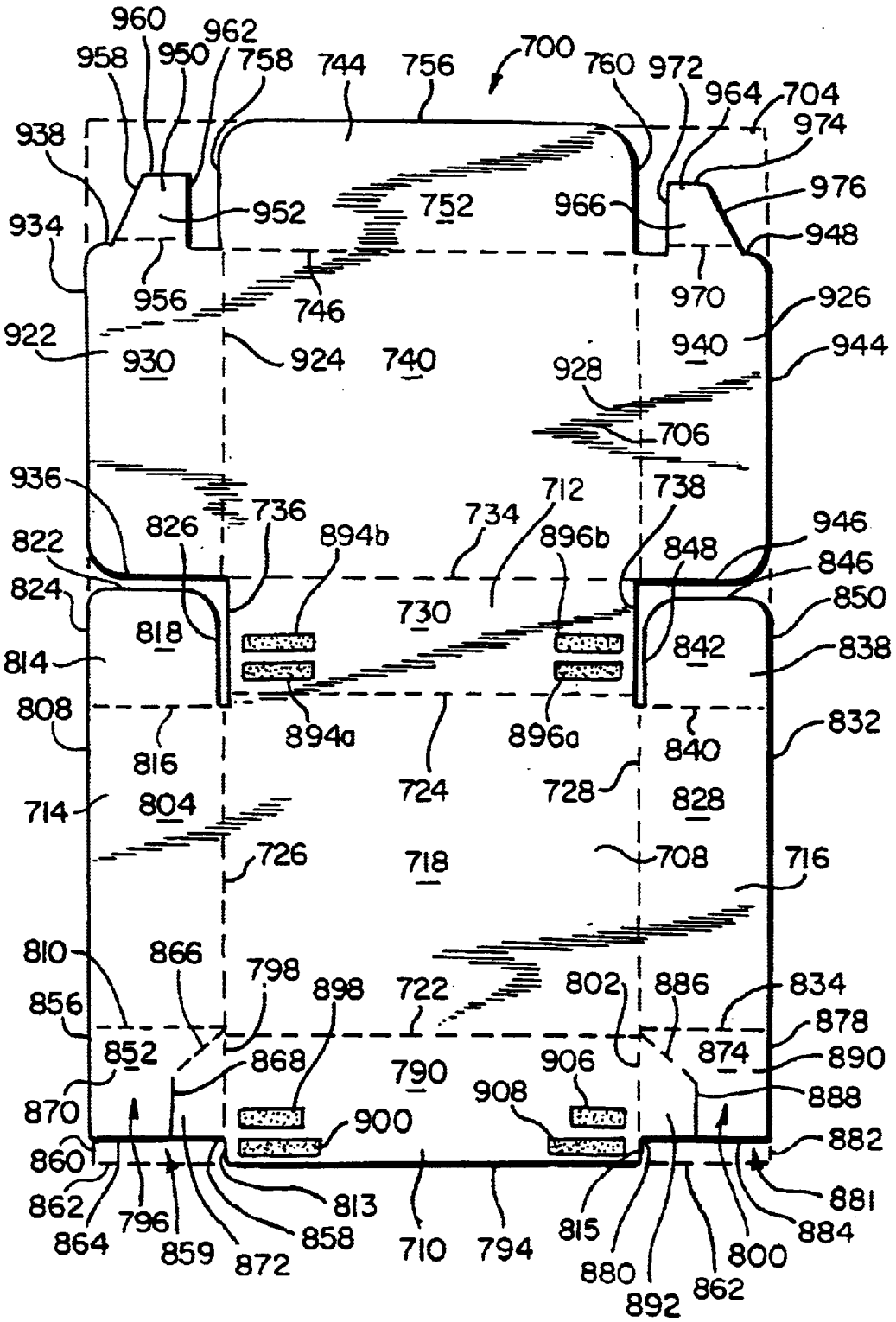
FIG. 13 is a top plan view of a blank in accordance with a third embodiment of the invention which is used to make a reclosable container.
Figure 14:
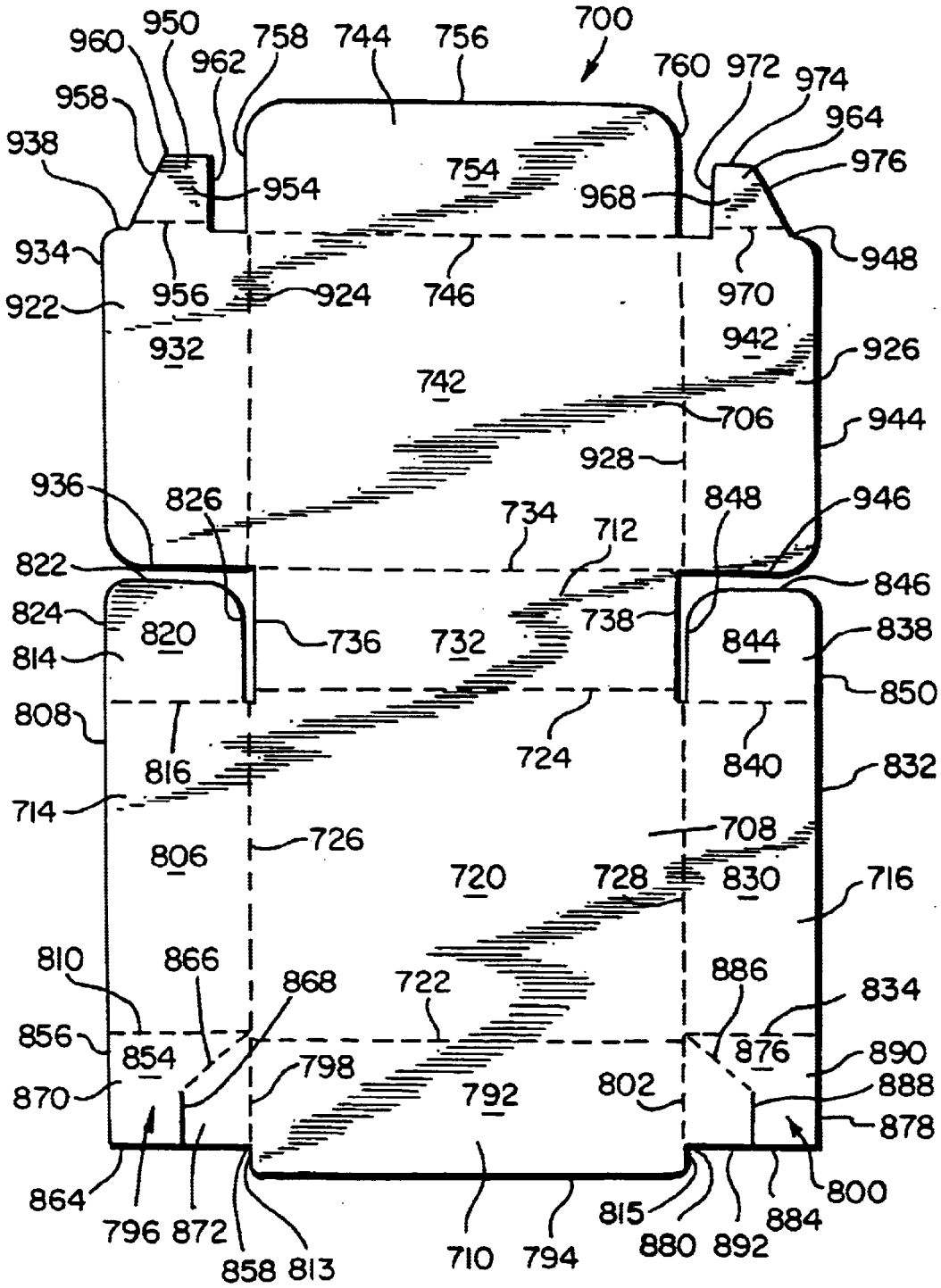
FIG. 14 is a bottom plan view of the blank illustrated in FIG. 13 which is used to make the reclosable container.

Attention is directed to FIGS. 13–18 and the third embodiment of the blank 700 used for forming the reclosable container 702. FIGS. 13 and 14 illustrate the blank 700. The blank 700 is a die cut blank which is cut out of a rectangular piece of material 704, which is illustrated in dashed line. The material 704 from which the blank 700 is die cut is preferably paperboard, but can also be formed of other suitable materials, such as, for example, double-faced corrugated cardboard, plastic, or the like.

The blank 700 is formed to have a plurality of primary panels, namely, a top panel 706, a bottom panel 708, a front panel 710, a rear panel 712, and first and second side panels 714, 716.

The bottom panel 708 is preferably of a rectangular configuration and has a top surface 718, illustrated in FIG. 13, and a bottom surface 720, illustrated in FIG. 14. The bottom panel 708 is connected to the front panel 710 along fold line 722. All fold lines discussed herein with regard to the third embodiment of the blank 700 are illustrated as dashed lines in FIGS. 13 and 14. The bottom panel 708 is connected to the rear panel 712 along fold line 724. Fold lines 722 and 724 are parallel to one another and, in a preferred embodiment of the blank 700, a distance from fold line 722 to fold line 724 is nine and three-eighths inches. The bottom panel 708 is connected to the first side panel 714 along fold line 726. The bottom panel 708 is connected to the second side panel 716 along fold line 728. Fold line 726 and fold line 728 are parallel to one another and, in a preferred embodiment of the blank 700, a distance from fold line 726 to fold line 728 is eleven and five-eighths inches. It is to be understood that all dimensions of the blank 700 provided herein are for a preferred embodiment of the blank 700 and that other sizes of blanks 700 can be provided for making varying sizes of reclosable containers 702 as desired.

The rear panel 712 is preferably of a rectangular configuration and has a top surface 730, illustrated in FIG. 13, and a bottom surface 732, illustrated in FIG. 14. The rear panel 712 is connected to the bottom panel 708 along fold line 724. The rear panel 712 is connected to the top panel 706 along fold line 734. Fold line 724 and fold line 734 are parallel to one another and, in a preferred embodiment of the blank 700, a distance from fold line 724 to fold line 734 is three and five-eighths inches. The rear panel 712 has a first side edge 736 and a second side edge 738. The first and second side edges 736, 738 are preferably not connected to any other portion of the blank 700. First and second side edges 736, 738 are parallel to one another and, in a preferred embodiment of the blank 700, a distance from first side edge 736 to second side edge 738 is eleven and three-eighths inches such that the first side edge 736 is offset from the fold line 726 by one-eighth of an inch and such that the second side edge 738 is offset from the fold line 728 by one-eighth of an inch.

The top panel 706 is preferably of a rectangular configuration and has a top surface 740, illustrated in FIG. 13, and a bottom surface 742, illustrated in FIG. 2. The top panel 706 is connected to the rear panel 712 along fold line 734. The top panel 706 is connected to a closure flap 744 along fold line 746. Fold line 734 and fold line 746 are parallel to one another and, in a preferred embodiment of the blank 700, a distance from fold line 734 to fold line 746 is nine and three-sixteenths inches. The top panel 706 is connected to a first external flap 922 along fold line 924. The top panel 706 is connected to a second external flap 926 along fold line 928. Fold line 924 and fold line 928 are parallel to one another and, in a preferred embodiment of the blank 700, a distance from the fold line 924 to the fold line 928 is eleven and seven-eighths inches such that the fold line 924 is offset from the first side edge 736 by one-fourth of an inch and such that fold line 928 is offset from the second side edge 738 by one-fourth of an inch.

The closure flap 744 is preferably of a rectangular configuration and has a top surface 752, illustrated in FIG. 13, and a bottom surface 754, illustrated in FIG. 14. The closure flap 744 is connected to the top panel 706 along fold line 746. The closure flap 744 has a top edge 756. Top edge 756 and fold line 746 are parallel to one another and, in a preferred embodiment of the blank 700, a distance from top edge 756 to fold line 746 is three and nine-sixteenth inches. The closure flap 744 has a first side edge 758 and a second side edge 760. First and second side edges 758, 760 are parallel to one another and, in a preferred embodiment of the blank 700, a distance from first side edge 758 to second side edge 760 is eleven and one-half inches such that the first side edge 758 is offset from the fold line 924 by three-sixteenths of an inch and such that the second side edge 760 is offset from the fold line 928 by three-sixteenths of an inch. The connection of the first side edge 758 to the top edge 756 is preferably rounded. The connection of the second side edge 760 to the top edge 756 is preferably rounded.

The first external flap 922 has a top surface 930, illustrated in FIG. 13, and a bottom surface 932, illustrated in FIG. 14. The first external flap 922 has a side edge 934. Fold line 924 and side edge 934 are parallel to one another and, in a preferred embodiment of the blank 700, a distance from fold line 924 to side edge 934 is three and seven-sixteenths inches. The first external flap 922 has a bottom edge 936 and a top edge 938. Bottom edge 936 and top edge 938 are parallel to one another and, in a preferred embodiment of the blank 700, a distance from bottom edge 936 to top edge 938 is nine and three-sixteenth inches such that the bottom edge 936 appears to be an extension of fold line 734 and such that the top edge 938 appears to be an extension of fold line 746. The connection between the bottom and top edges 936, 938 and the side edge 934 are preferably rounded. The side edge 934 and the bottom edge 936 are preferably not connected to any other portion of the blank 700.

The first external flap 922 has a locking tab 950 extending upwardly therefrom which is connected thereto between the fold line 924 and the side edge 934. The locking tab 950 is preferably of a trapezoidal configuration and has a top surface 952, illustrated in FIG. 13, and a bottom surface 954, illustrated in FIG. 14. Of course, it is to be understood that other geometrical configurations of the locking tab 950 could also be formed in keeping with the teachings of the present invention. Fold line 956 is provided along the connection of the locking tab 950 to the first external flap 922 such that it is offset from top edge 938 by one-eighth of an inch. Locking tab 950 has first, tapered side edge 958, a top edge 960, and a second side edge 962.

The second side edge 962 is connected to the top edge 938, with the connection therebetween preferably being rounded. The second side edge 962 is preferably parallel to the side edge 934. The top edge 960 extends from the second side edge 962, with the connection therebetween preferably being rounded. Top edge 960 is preferably parallel to fold line 956. In a preferred embodiment, a distance between fold line 956 and top edge 960 is two inches. The first, tapered side edge 958 extends from the top edge 960 to the top edge 938 of the first external flap 922. The connection between the first, tapered side edge 958 to the top edge 938 is preferably rounded. The first, tapered side edge 958 connects to the top edge 938 at a distance of one and one-sixteenth inches from the side edge 934. The second side edge 962 connects to the top edge 938 at a distance of thirteen-sixteenths of an inch from the fold line 924.

The second external flap 926 has a top surface 940, illustrated in FIG. 13, and a bottom surface 942, illustrated in FIG. 14. The second external flap 926 has a side edge 944. Fold line 928 and side edge 944 are parallel to one another and, in a preferred embodiment of the blank 700, a distance from fold line 928 to side edge 944 is three and seven-sixteenths inches. The second external flap 926 has a bottom edge 946 and a top edge 948. Bottom edge 946 and top edge 948 are parallel to one another and, in a preferred embodiment of the blank 700, a distance from bottom edge 946 to top edge 948 is nine and three-sixteenth inches such that the bottom edge 946 appears to be an extension of fold line 734 and such that the top edge 948 appears to be an extension of fold line 746. The connection between the bottom and top edges 946, 948 and the side edge 944 are preferably rounded. The side edge 944 and the bottom edge 946 are preferably not connected to any other portion of the blank 700.

The second external flap 926 has a locking tab 964 extending upwardly therefrom which is connected thereto between the fold line 928 and the side edge 944.

The locking tab 964 is preferably of a trapezoidal configuration and has a top surface 966, illustrated in FIG. 13, and a bottom surface 968, illustrated in FIG. 14. Of course, it is to be understood that other geometrical configurations of the locking tab 964 could also be formed in keeping with the teachings of the present invention. Fold line 970 is provided along the connection of the locking tab 964 to the second external flap 926 such that it is offset from top edge 948 by one-eighth of an inch. Locking tab 964 has first side edge 972, a top edge 974, and a second, tapered side edge 976.

The first side edge 972 is connected to the top edge 974, with the connection therebetween preferably being rounded. The first side edge 972 is preferably parallel to the side edge 944. The top edge 974 extends from the first side edge 972, with the connection therebetween preferably being rounded. Top edge 974 is preferably parallel to fold line 970. In a preferred embodiment, a distance between fold line 970 and top edge 974 is two inches. The second, tapered side edge 976 extends from the top edge 974 to the top edge 948 of the second external flap 926. The connection between the second, tapered side edge 976 to the top edge 974 is preferably rounded. The second, tapered side edge 976 connects to the top edge 974 at a distance of one and one-sixteenth inches from the side edge 944. The first side edge 972 connects to the top edge 974 at a distance of thirteen-sixteenths of an inch from the fold line 928.

The front panel 710 is preferably of a rectangular configuration and has a top surface 790, illustrated in FIG. 13, and a bottom surface 792, illustrated in FIG. 14. The front panel 710 is connected to the bottom panel 708 along fold line 722. The front panel 710 has a bottom edge 794. Fold line 722 and bottom edge 794 are parallel to one another and, in a preferred embodiment of the blank 700, a distance from fold line 722 to bottom edge 794 is three and five-eighth inches.

The front panel 710 is connected to a bellows panel 796 along fold line 798. Fold line 798 extends from the fold line 722 toward bottom edge 794 a distance of two and seven-eighths inches such that fold line 798 does not extend to the bottom edge 794 such that a first side edge 813 of the front panel 710 is provided. The connection between the first side edge 813 and the bottom edge 794 is preferably rounded. The front panel 710 is connected to a bellows panel 800 along fold line 802. Fold line 802 extends from the fold line 722 toward bottom edge 794 a distance of two and seven-eighths inches such that fold line 802 does not extend to the bottom edge 794 such that a second side edge 815 of the front panel 710 is provided. The connection between the second side edge 815 and the bottom edge 794 is preferably rounded. Fold line 798 and fold line 802 are parallel to one another and, in a preferred embodiment of the blank 700, a distance from fold line 798 to fold line 802 is eleven and five-eighths inches such that the fold line 798 appears to be an extension of fold line 726 and such that fold line 802 appears to be an extension of fold line 728.

The first side panel 714 is preferably of a rectangular configuration and has a top surface 804, illustrated in FIG. 13, and a bottom surface 806, illustrated in FIG. 14. The first side panel 714 is connected to the bottom panel 708 along fold line 726. The first side panel 714 has a side edge 808. Fold line 726 and side edge 808 are parallel to one another and, in a preferred embodiment of the blank 700, a distance from fold line 726 to side edge 808 is three and nine-sixteenths inches. The first side panel 714 is connected to the bellows panel 796 along fold line 810. The first side panel 714 is connected to a support flap 814 along fold line 816. Fold line 810 and fold line 816 are parallel to one another and, in a preferred embodiment of the blank 700, a distance from fold line 810 to fold line 816 is nine and one-eighth inches such that the fold line 810 is offset from fold line 722 by one-eighth of an inch and such that the fold line 816 is offset from fold line 724 by one-eighth of an inch.

The support flap 814 has a top surface 818, illustrated in FIG. 13, and a bottom surface 820, illustrated in FIG. 14. The support flap 814 has a top edge 822. Fold line 816 and top edge 822 are parallel to one another and, in a preferred embodiment of the blank 700, a distance from fold line 816 to top edge 822 is three and one-fourth inches. The support flap 814 has a first side edge 824 which, as illustrated in FIG. 13, appears to be an extension of side edge 808. The support flap 814 has a second side edge 826 which is parallel to side edge 736 and is separated therefrom, preferably by one-fourth of an inch, such that second side edge 826 is offset from fold line 826 by one-eighth of an inch. First side edge 824 and second side edge 826 are parallel to one another and, in a preferred embodiment of the blank 700, a distance from first side edge 824 to second side edge 826 is three and seven-sixteenths inches. The connection between the second side edge 826 and the top edge 822 is preferably rounded.

The second side panel 716 is preferably of a rectangular configuration and has a top surface 828, illustrated in FIG. 13, and a bottom surface 830, illustrated in FIG. 14. The second side panel 716 is connected to the bottom panel 708 along fold line 728. The second side panel 716 has a side edge 832. Fold line 728 and side edge 832 are parallel to one another and, in a preferred embodiment of the blank 700, a distance from fold line 728 to side edge 832 is three and nine-sixteenths inches. The second side panel 716 is connected to the bellows panel 800 along fold line 834. The second side panel 716 is connected to a support flap 838 along fold line 840. Fold line 834 and fold line 840 are parallel to one another and, in a preferred embodiment of the blank 700, a distance from fold line 834 to fold line 840 is nine and one-eighth inches such that the fold line 840 is offset from fold line 724 by one-eighth of an inch and such that the fold line 816 is offset from fold line 724 by one-eighth of an inch.

The support flap 838 has a top surface 842, illustrated in FIG. 13, and a bottom surface 844, illustrated in FIG. 14. The support flap 838 has a top edge 846. Fold line 840 and top edge 846 are parallel to one another and, in a preferred embodiment of the blank 700, a distance from fold line 840 to top edge 846 is three and one-fourth inches. The support flap 838 has a first side edge 848 which is parallel to first side edge 738 and is separated therefrom, preferably by one-fourth of an inch, such that first side edge 848 is offset from fold line 728 by one-eighth of an inch. The support flap 838 has a second side edge 850 which, as illustrated in FIG. 13, appears to be an extension of side edge 832. First side edge 848 and second side edge 850 are parallel to one another and, in a preferred embodiment of the blank 700, a distance from first side edge 848 to second side edge 850 is three and seven-sixteenths inches. The connection between the second side edge 850 and the top edge 846 is preferably rounded.

The bellows panel 796 has a top surface 852, illustrated in FIG. 13, and a bottom surface 854, illustrated in FIG. 14. The bellows panel 796 is connected to the front panel 710 along fold line 798. The bellows panel 796 has a side edge 856. Fold line 798 and side edge 856 are parallel to one another and, in a preferred embodiment of the blank 700, a distance from the fold line 798 to the side edge 856 is three and nine-sixteenth inches. The bellows panel 796 has a bottom edge 864. The bottom edge 864 and the fold line 810 are parallel to one another and, in a preferred embodiment of the blank 700 a distance from the bottom edge 864 to the fold line 810 is three inches. As the bottom edge 864 does not extend to the bottom edge 794, a shoulder 858 is defined by bottom edge 864 and first side edge 813. Thus, it is to be understood that a corner or relief portion 859 is bounded by the bottom edge 864 and the first side edge 813 which defines the shoulder 858, a side edge 860 of the material 704, and a bottom edge 862 of the material 704, as illustrated in FIG. 13. The purpose for cutting the blank 700 from the material 704 in such a manner will be explained herein in connection with forming the blank 700 into the reclosable container 702.

From the junction of the fold line 726, the fold line 798, and the fold line 810, a fold line 866 is provided which extends onto the bellows panel 796 at an angle, preferably forty-five degrees. A cut line 868 extends from the fold line 866 to the bottom edge 864. The cut line 868 and the fold line 798 are parallel to one another and, in a preferred embodiment of the blank 700, a distance from the cut line 868 to the fold line 798 is one and one-half inches. The fold line 866 and the cut line 868 separate the bellows panel 796 into a first bellows section 870 and a second bellows section 872. The first bellows section 870 is bounded by fold line 798, bottom edge 864, side edge 856, cut line 868 and fold line 866. The second bellows section 872 is bounded by fold line 810, fold line 866, cut line 868 and side edge 856.

The bellows panel 800 has a top surface 874, illustrated in FIG. 13, and a bottom surface 876, illustrated in FIG. 14. The bellows panel 800 is connected to the front panel 710 along fold line 802. The bellows panel 800 has a side edge 878. Fold line 802 and side edge 878 are parallel to one another and, in a preferred embodiment of the blank 700, a distance from the fold line 802 to the side edge 878 is three and nine-sixteenth inches. The bellows panel 800 has a bottom edge 884. The bottom edge 884 and the fold line 834 are parallel to one another and, in a preferred embodiment of the blank 700 a distance from the bottom edge 884 to the fold line 834 is three inches. As the bottom edge 884 does not extend to the bottom edge 794, a shoulder 880 is defined by bottom edge 884 and second side edge 815. Thus, it is to be understood that a corner or relief portion 881 is bounded by the bottom edge 884 and the second side edge 815 which defines the shoulder 880, a side edge 882 of the material 704, and a bottom edge 862 of the material 704, as illustrated in FIG. 13. The purpose for cutting the blank 700 from the material 704 in such a manner will be explained herein in connection with forming the blank 700 into the reclosable container 702.

From the junction of the fold line 728, the fold line 802, and the fold line 834, a fold line 886 is provided which extends onto the bellows panel 800 at an angle, preferably forty-five degrees. A cut line 888 extends from the fold line 886 to the bottom edge 884. The cut line 888 and the fold line 802 are parallel to one another and, in a preferred embodiment of the blank 700, a distance from the cut line 888 to the fold line 802 is one and one-half inches. The fold line 886 and the cut line 888 separate the bellows panel 800 into a first bellows section 890 and a second bellows section 892. The first bellows section 890 is bounded by fold line 802, bottom edge 884, side edge 878, cut line 888 and fold line 886. The second bellows section 892 is bounded by fold line 834, fold line 886, cut line 888 and side edge 878.

Adhesives, such as glue, are also preferably applied to the blank 700 for the formation of the reclosable container 702, as will be discussed herein. First and second adhesive portions 894*a*, 894*b* are applied to the rear panel 712 on the top surface 830 thereof proximate to the first side edge 736 and parallel to the fold line 724. The first and second adhesive portions 894*a*, 894*b* are used for securing the support flap 814 to the rear panel 712 as will be discussed further herein. Third and fourth adhesive portions 896*a*, 896*b* are applied to the rear panel 712 on the top surface 830 thereof proximate to the second side edge 738 and parallel to the fold line 724. The third and fourth adhesive portions 896*a*, 896*b* are used for securing the support flap 838 to the rear panel 712 as will be discussed further herein. A fifth adhesive portion 898 is applied to the front panel 710 on the top surface 790 thereof proximate to the fold line 798 and parallel to the bottom edge 794. The fifth adhesive portion 898 is used for securing the second bellows section 872 of the bellows panel 796 to the front panel 710. A sixth adhesive portion 900 is applied to the front panel 710 on the top surface 790 thereof proximate to the junction of the first side edge 813 and the bottom edge 794 and is parallel to the bottom edge 794 such that the sixth adhesive portion 900 is provided between the fifth adhesive portion 898 and the bottom edge 794. The sixth adhesive portion 900 is used for securing the first bellows section 870 of the bellows panel 796 to the front panel 710. A seventh adhesive portion 906 is applied to the front panel 710 on the top surface 790 thereof proximate to the fold line 802 and parallel to the bottom edge 794. The seventh adhesive portion 906 is used for securing the second bellows section 892 of the bellows panel 800 to the front panel 710. An eighth adhesive portion 908 is applied to the front panel 710 on the top surface 790 thereof proximate to the junction of the second side edge 815 and the bottom edge 794 and is parallel to the bottom edge 794 such that the eighth adhesive portion 908 is provided between the seventh adhesive portion 907 and the bottom edge 794. The eighth adhesive portion 908 is used for securing the first bellows section 890 of the bellows panel 800 to the front panel 710. Each of the adhesives preferably has a width of three-sixteenths inches.

The method of forming the reclosable container 702 using the blank 700 as described will now be discussed and attention is directed to FIGS. 15–20.

Figure 15:
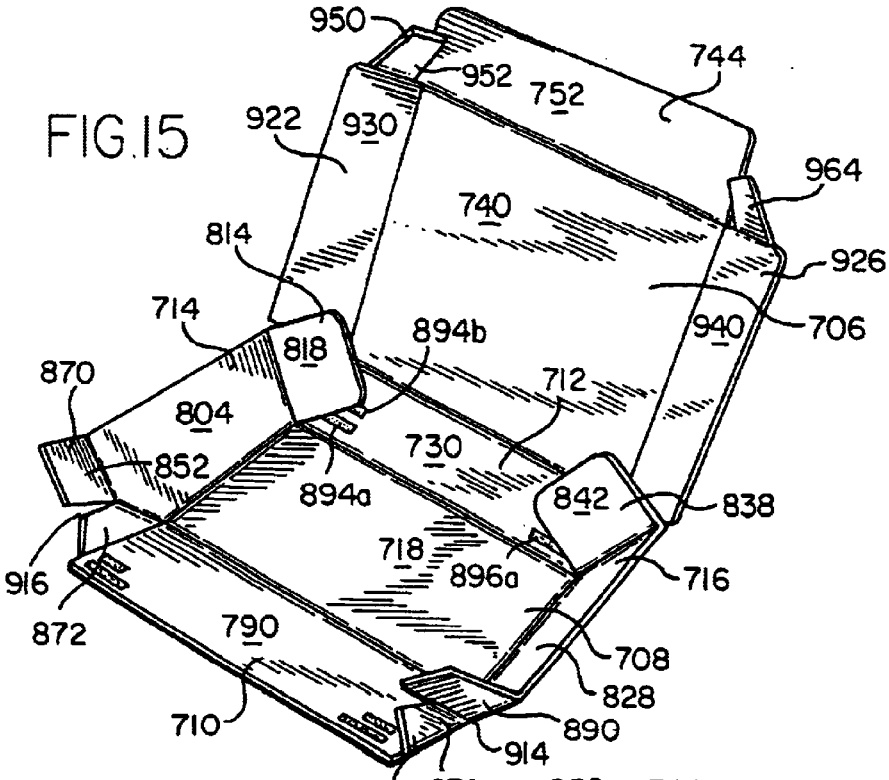
FIG. 15 is a perspective view of the blank illustrated in FIG. 13 being erected to form the reclosable container.
Figure 16:
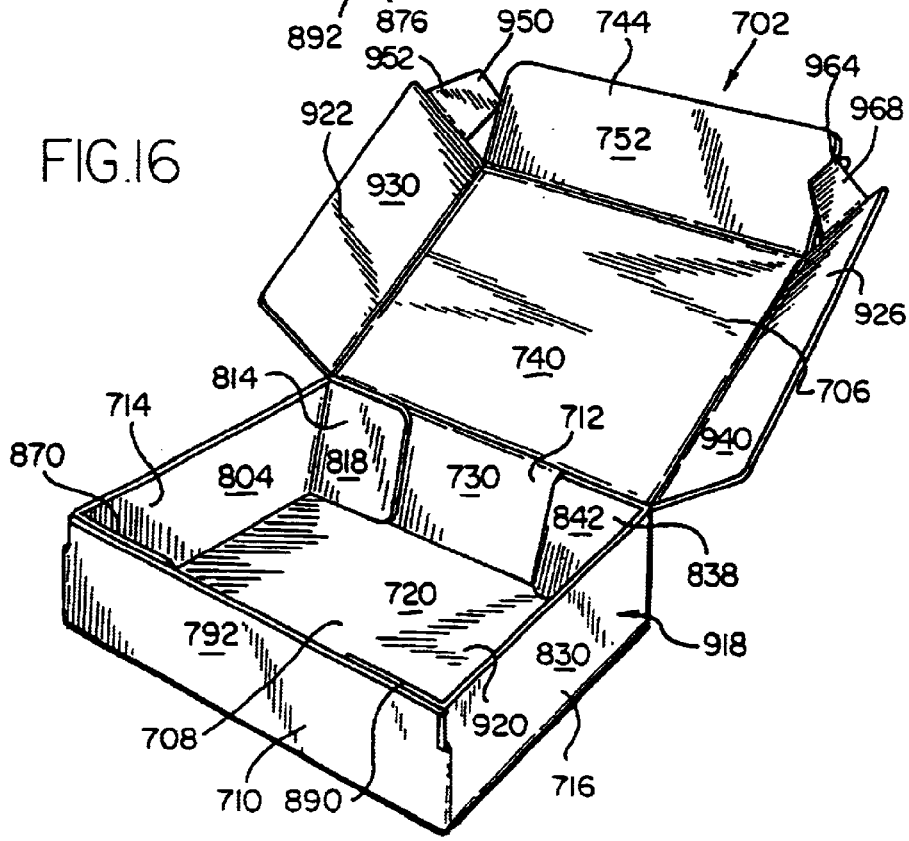
FIG. 16 is a perspective view of the reclosable container erected from the blank illustrated in FIG. 13 with the top or lid of the reclosable container being in an open position.

With reference to FIGS. 15 and 16, the front panel 710 is folded upwardly from the bottom panel 708 along fold line 722; the rear panel 712 is folded upwardly from the bottom panel 708 along fold line 724; the first side panel 714 is folded upwardly from the bottom panel 708 along fold line 726; and the second side panel 716 is folded upwardly from the bottom panel 708 along the fold line 728. The folding of the front panel 710, the rear panel 712, the first side panel 714 and the second side panel 716 upwardly from the bottom panel 708 typically occur simultaneously, but it should be understood that the folding of one or more of the panels 710, 712, 714, 716 could be performed prior to the folding of the other of the panels 710, 712, 714, 716.

As best illustrated in FIG. 15, as the first side panel 714 is folded upwardly from the bottom panel 708 along fold line 726, the support flap 814 is folded inwardly along fold line 816 such that the bottom surface 820 of the support flap 814 faces the top surface 730 of the rear panel 710 and, thus, the first and second adhesive portions 894*a*, 894*b* provided on the top surface 730 of the rear panel 710. Once the rear panel 712 and the first side panel 714 are positioned perpendicular to one another, as well as perpendicular to the bottom panel 708, the bottom surface 820 of the support flap 814 is securely bonded to the top surface 730 of the rear panel 712 by the first and second adhesive portions 894*a*, 894*b*, as illustrated in FIG. 16. Likewise, as the second side panel 716 is folded upwardly from the bottom panel 708 along fold line 728, the support flap 838 is folded inwardly along fold line 840 such that the bottom surface 844 of the support flap 838 faces the top surface 730 of the rear panel 710 and, thus, the third and fourth adhesive portions 896*a*, 896*b* provided on the top surface 730 of the rear panel 710. Once the rear panel 712 and the second side panel 716 are positioned perpendicular to one another, as well as perpendicular to the bottom panel 708, the bottom surface 844 of the support flap 838 is securely bonded to the top surface 730 of the rear panel 712 by the third and fourth adhesive portions 896*a*, 896*b*, as illustrated in FIG. 16. The folding of the support flap 814 and the support flap 838 inwardly typically occur simultaneously, but it should be understood that the folding of one of the support flaps 814, 838 could be performed prior to the folding of the other of the support flaps 814, 838.

As the front panel 710 and the second side panel 716 are folded upwardly from the bottom panel 708, the bellows panel 800 is folded inwardly along fold line 802, 834. The bellows panel 800 is also V-folded along fold line 886. The folding of the bellows panel 800 along fold lines 802, 834, 886 provides that the top surface 874 of the second bellows section 892 faces the top surface 790 of the front panel 710 and, thus, the seventh adhesive portion 906 provided on the top surface 790 of the front panel 710. The folding of the bellows panel 800 along fold lines 802, 834, 886 further provides that the bottom surface 876 of the first bellows section 890 faces the top surface 790 of the front panel 710 and, thus, the seventh and eighth adhesive portions 906, 908 provided on the top surface 790 of the front panel 710. The bottom surface 876 of the first bellows section 890 is allowed to face the eighth adhesive portion 908 proximate to the side edge 815 because the blank 700 was cut from the material 704 such that the relief portion 881 was not included as part of the bellows panel 800 of the blank 700. As the blank 700 is cut from the material 704 and does not include the relief portion 881, the adhesives used for forming the reclosable container 702 need only be applied to one side of the blank 700, such that two complete applicator heads are not necessary. The bottom surface 876 of the first bellows section 890 also faces the bottom surface 876 of the second bellows section 892 as the two bellows sections 890, 892 V-fold along the fold line 886 such that a slot or aperture 914 is formed between the bottom surface 876 of the first bellows section 890 and the bottom surface 876 of the second bellows section 892.

Once the front panel 710 and the second side panel 716 are perpendicular to one another, as well as perpendicular to the bottom panel 708, the top surface 874 of the second bellows section 892 is bounded to the top surface 790 of the front panel 710 by the seventh adhesive portion 906, as illustrated in FIG. 16, and the bottom surface 876 of the first bellows section 890 is bonded to the top surface 790 of the front panel 710 by the seventh and eighth adhesive portions 906, 908. A portion of the bottom surface 876 of the first bellows section 890 is not bonded to the top surface 790 of the front panel 716, but rather faces the bottom surface 876 of the second bellows section 892 such that the slot 914 is provided therebetween.

One side of an opening to the slot 914 is provided at the fold line 802 while the other side of the opening to the slot 914 is provided at the fold line 834 such that the sides of the opening to the slot 914 are smooth and rounded. Thus, the opening to the slot 914 is bounded by smooth edges with no raw or cut edges.

Similarly, as the front panel 710 and the first side panel 714 are folded upwardly from the bottom panel 708, the bellows panel 796 is folded inwardly along fold line 798, 810. The bellows panel 796 is also V-folded along fold line 866. The folding of the bellows panel 796 along fold lines 798, 810, 866 provides that the top surface 852 of the second bellows section 872 faces the top surface 790 of the front panel 710 and, thus, the fifth adhesive portion 898 provided on the top surface 790 of the front panel 710. The folding of the bellows panel 796 along fold lines 798, 810, 866 further provides that the bottom surface 854 of the first bellows section 870 faces the top surface 790 of the front panel 710 and, thus, the fifth and sixth adhesive portions 898, 900 provided on the top surface 790 of the front panel 710. The bottom surface 854 of the first bellows section 870 is allowed to face the sixth adhesive portion 900 proximate to side edge 813 because the blank 700 was cut from the material 704 such that the relief portion 859 was not included as part of the bellows panel 796 of the blank 700. As the blank 700 is cut from the material 704 and does not include the relief portion 859, the adhesives used for forming the reclosable container 702 need only be applied to one side of the blank 700, such that two complete applicator heads are not necessary. The bottom surface 854 of the first bellows section 870 also faces the bottom surface 854 of the second bellows section 872 as the two bellows sections 870, 872 V-fold along the fold line 866 such that a slot or aperture 916 is formed between the bottom surface 854 of the first bellows section 870 and the bottom surface 854 of the second bellows section 872.

Once the front panel 710 and the first side panel 714 are perpendicular to one another, as well as perpendicular to the bottom panel 708, the top surface 852 of the second bellows section 872 is bounded to the top surface 790 of the front panel 710 by the fifth adhesive portion 898, as illustrated in FIG. 16, and the bottom surface 854 of the first bellows section 870 is bonded to the top surface 790 of the front panel 710 by the fifth and sixth adhesive portions 898, 900. A portion of the bottom surface 854 of the first bellows section 870 is not bonded to the top surface 790 of the front panel 716, but rather faces the bottom surface 854 of the second bellows section 872 such that the slot 916 is provided therebetween.

One side of an opening to the slot 916 is provided at the fold line 798 while the other side of the opening to the slot 916 is provided at the fold line 810 such that the sides of the opening to the slot 916 are smooth and rounded. Thus, the opening to the slot 916 is bounded by smooth edges with no raw or cut edges.

Thus, as best illustrated in FIG. 16, the blank 700 is first formed to provide a base tray portion 918 having the top panel 706 extending therefrom. The base tray portion 918 has an opening 920 configured to receive material to be packed into the reclosable container 702, for instance, meat, poultry, and office supplies. The base tray portion 918 is sturdy and in an upright condition.

Once the base tray portion 918 is formed, the top panel 706 can be manipulated to securely close off the opening 920. As best illustrated in FIG. 16, the closure flap 744 is folded along the fold line 746 until the closure flap 744 is generally perpendicular to the top panel 706. The top panel 706 is folded along the fold line 734 such that the top panel 706 moves over the opening 920 of the base tray portion 918.

As the top panel 706 moves over the opening 920 of the base tray portion 918, such that the top panel 706 is parallel to the bottom panel 708 and perpendicular to the front, rear, first side and second side panels 710, 712, 714, 716, the closure flap 944 is moved into the opening 920 of the base tray portion 918 such that the bottom surface 754 of the closure flap 744 is positioned against the top surface 790 of the front panel 710, the top surface 852 of the first bellows section 870 of the bellows panel 796, and the top surface 874 of the first bellows section 890 of the bellows panel 800.

Figure 17:
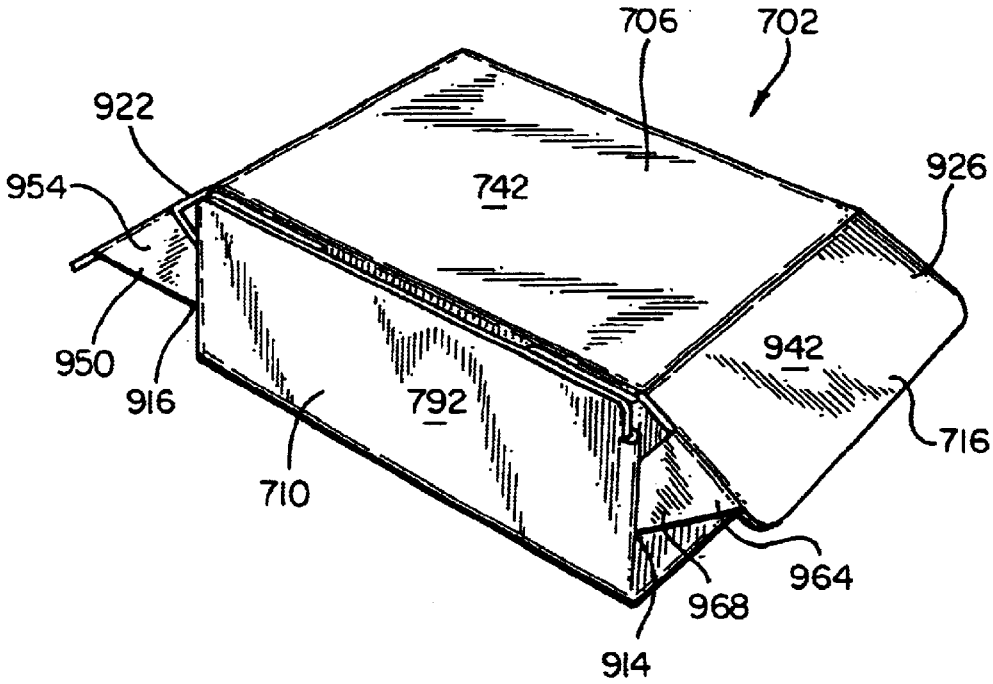
FIG. 17 is a perspective view of the reclosable container erected from the blank illustrated in FIG. 13 with tab portions of the top or lid of the reclosable container being received in the slot formed by the bellows corner panel.

The tab 950 is folded along fold line 956 such that the tab 950 is perpendicular to the first external flap 922. The first external flap 922 is then folded along fold line 924, as best illustrated in FIG. 17. As the first external flap 922 is folded along fold line 924, the tab 950 is inserted into slot 916 such that the top surface 952 of the tab 950 faces the portion of the bottom surface 854 of the first bellows section 870 which is not bonded to the top surface 790 of the front panel 710 and the bottom surface 954 of the tab 950 faces the bottom surface 854 of the second bellows section 872.

The tab 950 is configured as described herein such that it is inserted into the slot 916 and underneath the sixth adhesive portion 900 until the first external flap 922 is perpendicular to the top panel 706 and the top surface 930 of the first external flap 922 faces the bottom surface 806 of the first side panel 714. The slot 916 is sized to accept the tab 950. The tab 950 is trapped and further secured within the slot 916 by friction created by the bellows panel 796 as the bellows panel 796 effectively "pinches" the tab 950 within the slot 916 to secure the tab 950 therein. The "pinch" is caused by the bottom surface 854 of the first bellows section 870 being bonded to the sixth adhesive portion 900.

Similarly, the tab 964 is folded along fold line 970 such that the tab 964 is perpendicular to the second external flap 926. The second external flap 926 is then folded along fold line 928, as best illustrated in FIG. 17. As the second external flap 926 is folded along fold line 928, the tab 964 is inserted into slot 914 such that the top surface 966 of the tab 964 faces the portion of the bottom surface 876 of the first bellows section 890 which is not bonded to the top surface 790 of the front panel 710 and the bottom surface 968 of the tab 964 faces the bottom surface 876 of the second bellows section 892.

The tab 964 is configured as described herein such that it is inserted into the slot 914 and underneath the eighth adhesive portion 908 until the second external flap 926 is perpendicular to the top panel 706 and the top surface 940 of the second external flap 926 faces the bottom surface 830 of the second side panel 716. The slot 914 is sized to accept the tab 964. The tab 964 is trapped and further secured within the slot 914 by friction created by the bellows panel 800 as the bellows panel 800 effectively "pinches" the tab 964 within the slot 914 to secure the tab 964 therein. The "pinch" is caused by the bottom surface 876 of the first bellows section 890 being bonded to the eighth adhesive portion 908.

Figure 18:
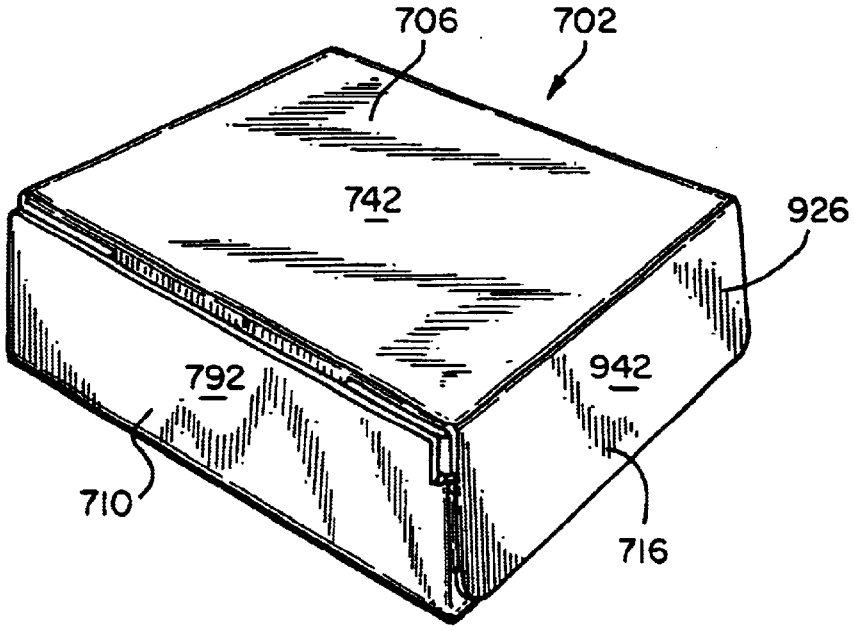
FIG. 18 is a perspective view of the reclosable container erected from the blank illustrated in FIG. 13 with the top or lid of the reclosable container being in a closed position.

The reclosable container 702 is thus in a secured, closed position, as illustrated in FIG. 18.

As the slots 914, 916 do not have any raw or cut edges at the opening thereof, the tabs 964, 950, respectively, can be inserted and removed from the slots 914, 916, in order to open and close the container 702 without the concern of the tabs 950, 964 being damaged or frayed because of repeated contact with raw or cut edges.

It is to be understood that other geometrical configurations of the blank 700 could be formed, such as a pentagon or a hexagon, by changing the configuration of the top and bottom panels 706, 708 and adding side panels and bellows corner panels as necessary.

Figure 19:
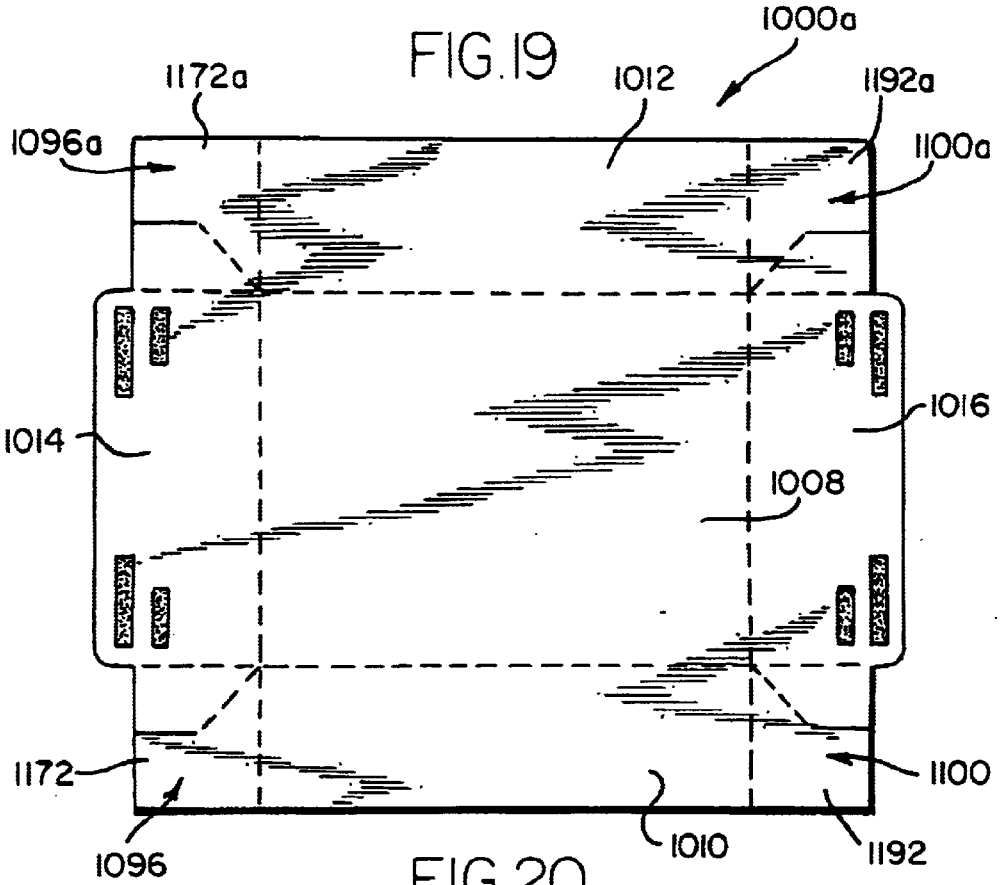
FIG. 19 is a top plan view of a first blank in accordance with a fourth embodiment of the invention which is used to make a two-piece reclosable container.
Figure 20:
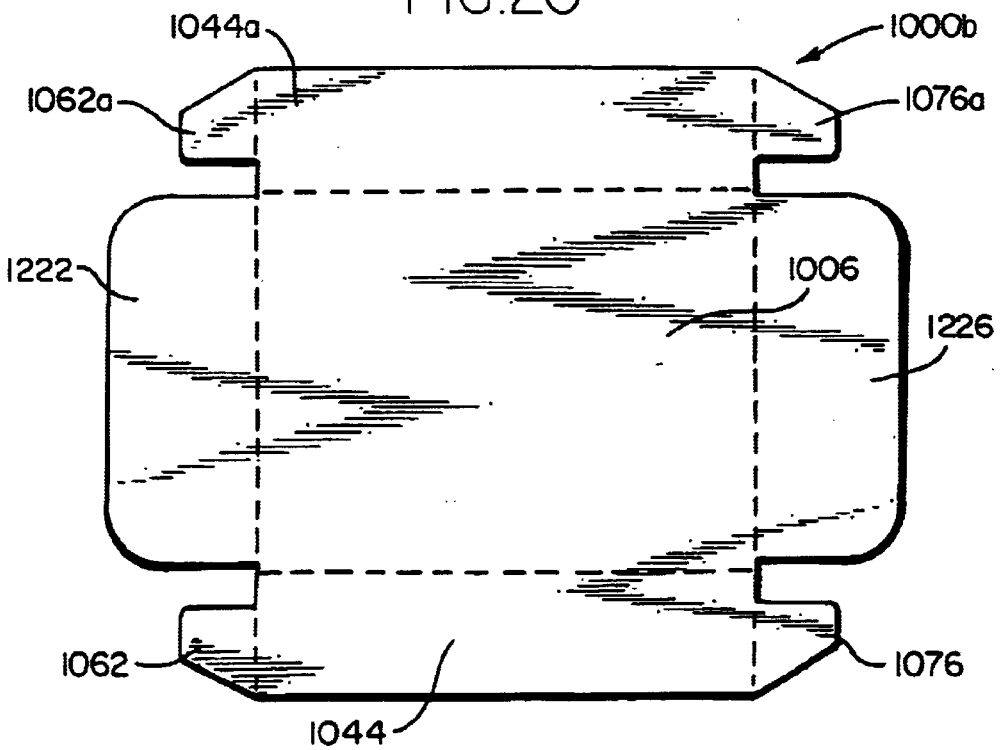
FIG. 20 is a top plan view of a second blank in accordance with a fourth embodiment of the invention which is used to make the two-piece reclosable container.

Attention is directed to FIGS. 19–22 and the fourth embodiment of the blank 1000*a*, 1000*b* used for forming the reclosable container 1002. FIG. 19 illustrates the blank 1000*a* and FIG. 20 illustrates the blank 1000*b*. The blanks 1000*a*, 1000*b* are die cut blanks which are cut out of material. The material from which the blanks 1000*a*, 1000*b* are die cut is preferably paperboard, but can also be formed of other suitable materials such as, for example, double-faced corrugated cardboard, plastic, or the like.

As can be seen from FIGS. 19–22, the blanks 1000*a*, 1000*b* are used to form a two-piece reclosable container 1002, as opposed to the one-piece reclosable containers 102, 402, 702 described and illustrated in connection with the first, second and third embodiments of the invention.

Figure 21:
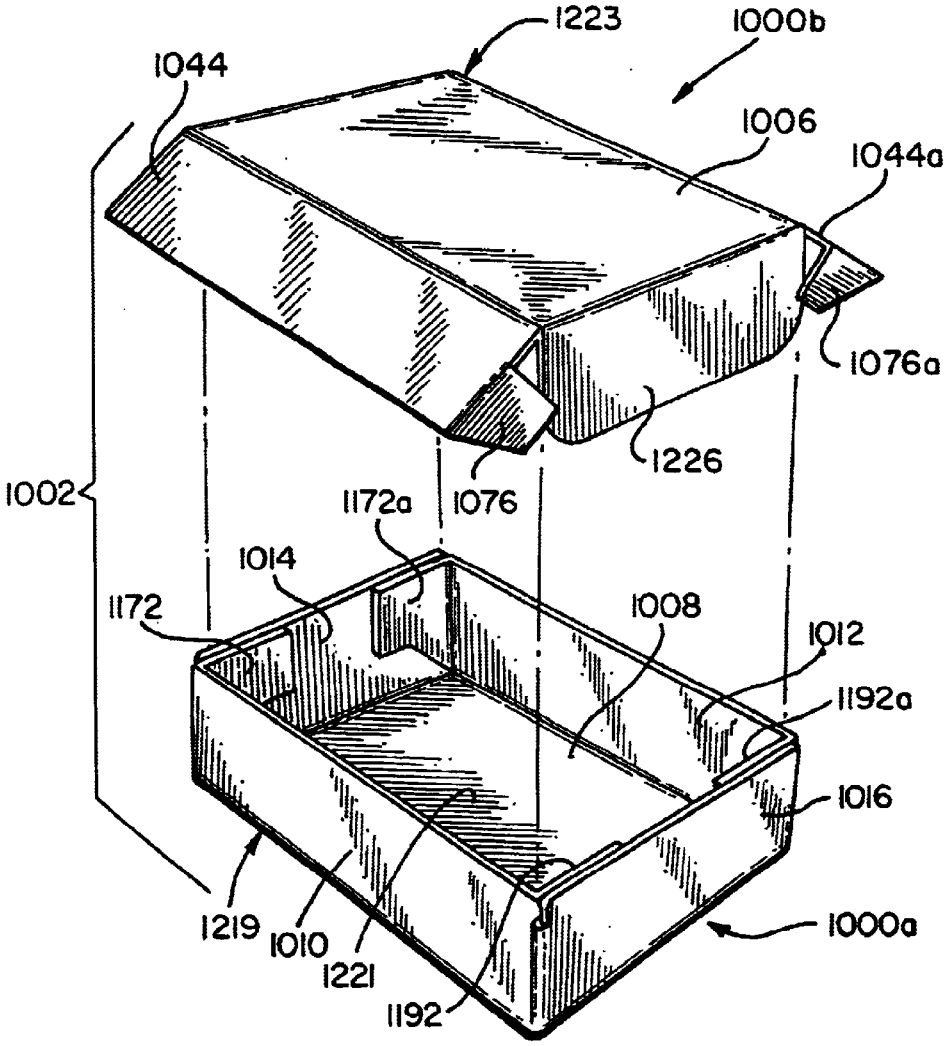
FIG. 21 is a perspective view of the two-piece reclosable container erected from the blanks illustrated in FIGS. 19 and 20, prior to the two-piece reclosable container being in a closed position.

The blank 1000*a* is used to form a base tray portion 1219 of the reclosable container 1002, as is illustrated in FIG. 21. The base tray portion 1219 of the reclosable container 1002 has an opening 1221 configured to receive material to be packed into the reclosable container 1002, for instance, meat, poultry, and office supplies. The base tray portion 1219 is sturdy and in an upright condition.

The blank 1000*b* is used to form a top or lid 1223 of the reclosable container 1002, as is illustrated in FIG. 21. The top or lid 1223 can be used to securely close off the opening 1221 of the base tray portion 1219.

As is evident from a study of FIG. 19, the blank 1000*a* has a bottom panel 1008, a front panel 1010, a rear panel 1012, and first and second side panels 1014, 1016, similar to the blanks 100, 400 of the first and second embodiments. Also similar to the blanks 100, 400 of the first and second embodiments, the blank 1000*a* has a bellows panel 1096 which connects the front panel 1010 to the first side panel 1014 and a bellows panel 1100 which connects the front panel 1010 to the second side panel 1016. The blank 1000*a*, however, also has a bellows panel 1096*a* which connects the rear panel 1012 to the first side panel 1014 and a bellows panel 1100*a* which connects the rear panel 1012 to the second side panel 1016. As the configuration of the bellows panels 1096, 1096*a*, 1100, 1100*a*, as well as the method for folding and attaching same is to be understood from the description of same in connection with the first and second embodiments, the discussion thereof will not be repeated herein.

As is evident from a study of FIG. 20, the blank 1000*b* has a top panel 1006, a first closure flap 1044, a second closure flap 1044*a*, a first internal flap 1222, and a second internal flap 1226. The first closure flap 1044 also has first and second locking tabs 1062, 1076 extending from opposite ends thereof, which are similar in construction to the locking tabs 162, 176 on the closure flap 144 of the first embodiment. Likewise, the second closure flap 1044*a* also has first and second locking tabs 1062*a*, 1076*a* extending from opposite ends thereof.

Figure 22:
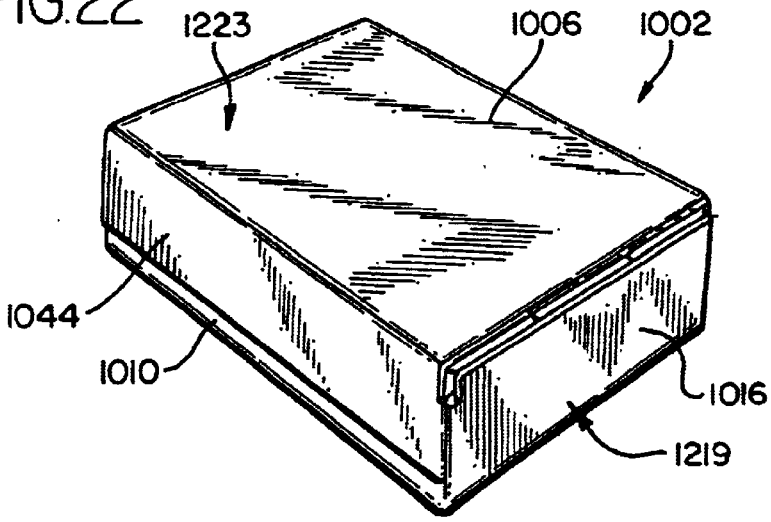
FIG. 22 is a perspective view of the two-piece reclosable container erected from the blanks illustrated in FIGS. 19 and 20, with the two-piece reclosable container being in a closed position.

As best illustrated in FIG. 22, the top panel 1006 closes off the opening 1221 of the base tray portion 1219. The first inner flap 1222 is positioned within the opening 1221 and against the first side panel 1014, the second bellows section 1172 of the bellows panel 1096, and the second bellows section 1172*a* of the bellows panel 1096*a*. The second inner flap 1226 is positioned within the opening 1221 and against the second side panel 1016, the second bellows section 1192 of the bellows panel 1100, and the second bellows section 1192*a* of the bellows panel 1100*a*.

The locking tabs 1062, 1062*a*, 1076, 1076*a* are then inserted into the respective slots formed by the bellows panels 1096, 1096*a*, 1100, 1100*a* to securely close off the opening 1221.

It should be understood that the blanks 1000*a*, 1000*b* could also be modified such that the reclosable container 1002 is formed more similarly to the reclosable container 702 of the third embodiment rather than the reclosable containers 102, 402 of the first and second embodiments.

Thus, the described reclosable containers 102, 402, 702, 1002 use significantly less material than reclosable containers of the prior art, while at the same time, the described reclosable containers 102, 402, 702, 1002 waste less material than reclosable containers of the prior art, such that a manufacturer of the containers 102, 402, 702, 1002 would realize approximately a 10–25% material cost savings in comparison to prior art reclosable containers. The reclosable containers 102, 402, 702, 1002 are easy to use and construct and are just as sturdy as the reclosable containers of the prior art. The reclosable containers 102, 402, 702, 1002 also require that adhesive need only be applied to one side of the blanks 100, 400, 700, 1000*a*, 1000*b* used for forming the reclosable containers 102, 402, 702, 1002, respectively. The reclosable containers 102, 402, 702, 1002 each have bellows corner panels defining slots therein, and tabs where the tabs are trapped and further secured within the slots by the friction created by opposing sections of the bellows corner panels. The slots have openings which are smooth and are not bounded by raw or cut edges such that the tabs do not become damaged upon multiple openings and closings of the containers 102, 402, 702, 1002.

While preferred embodiments of the present invention are shown and described, it is envisioned that those skilled in the art may devise various modifications of the present invention without departing from the spirit and scope of the appended claims.

The invention claimed is:

1. A blank for forming a re-closable container which is cut from a piece of material, said blank comprising:

a bottom panel;

an end panel foldingly attached to a first perimeter edge of said bottom panel;

a side panel foldingly attached to a second perimeter edge of said bottom panel, one of said side and end panels having an adhesive applied thereto;

a bellows panel attached to said one end panel and to said side panel, said bellows panel having first and second bellows sections which are configured to V-fold along a fold line which separates said first bellows sections from said second bellows section, said blank being cut from the piece of material such that a relief area of the piece of material is provided proximate to said bellows panel to form a shoulder between one of said side and end panels and said bellows panel;

said first and second bellows sections v-folding when said side and end panels are folded to an upright position relative to said bottom panel such that said shoulder of said bellows panel allows said second bellows section to be bonded to said adhesive applied to one of said side or end panels, and such that a slot having an opening with no raw or cut edges is formed between said first and second bellows sections, said slot being configured to receive and frictionally secure a portion of said blank therein, said portion of said blank which is received and frictionally secured within said slot being provided to assist in the closure of said container.

2. A blank as defined in claim 1, wherein said adhesive is applied to a top surface of one of said side or end panels.

3. A blank as defined in claim 1, wherein said adhesive is applied proximate to and along an outer edge of one of said side or end panels.

4. A blank as defined in claim 1, wherein a second adhesive is applied to one of said side or end panels.

5. A blank as defined in claim 4, wherein said second adhesive is applied between said adhesive and said bottom panel.

6. A blank as defined in claim 4, wherein said first bellows section is bonded to said second adhesive applied to one of said side or end panels when said side and end panels are folded to an upright position.

7. A blank as defined in claim 6, wherein said second bellows section is bonded to said second adhesive applied to one of said side or end panels when said side and end panels are moved to an upright position.

8. A blank as defined in claim 1, further comprising an end panel attached to a third perimeter edge of said bottom panel and a top panel attached to a perimeter of said end panel attached to said third perimeter edge of said bottom panel, said top panel having said portion of said blank which is received and frictionally secured within said slot.

9. A blank as defined in claim 1, wherein said adhesive is applied to said end panel.

10. A blank as defined in claim 1, wherein said adhesive is applied to said side panel.

11. A blank for forming a re-closable container which is cut from a piece of material, said blank comprising:

a bottom panel;

a first end panel foldingly attached to a first perimeter edge of said bottom panel;

a second end panel attached to a third perimeter edge of said bottom panel;

a side panel foldingly attached to a second perimeter edge of said bottom panel, one of said side and end panels having an adhesive applied thereto;

a top panel attached to a perimeter of said second end panel;

a bellows panel attached to said end panels and to said side panel, said bellows panel having first and second bellows sections which are configured to V-fold along a fold line which separates said first bellows sections from said second bellows section, said blank being cut from the piece of material such that a relief area of the piece of material is provided proximate to said bellows panel to form a shoulder between one of said side and end panels and said bellows panel;

said first and second bellows sections v-folding when said side and end panels are folded to an upright position relative to said bottom panel such that said shoulder of said bellows panel allows said second bellows section to be bonded to said adhesive applied applied to one of said side or end panels, and such that a slot having an opening with no raw or cut edges is formed between said first and second bellows sections, said top panel has a closure flap with a locking tab on an end of said closure flap, said locking tab configured to, upon formation of said re-closable container, be slidably inserted into said slot such that said locking tab is frictionally secured within said slot.

12. A blank in combination with a separate blank for forming a re-closable container which is cut from a piece of material, said blank comprising:

a bottom panel;

an end panel foldingly attached to a first perimeter edge of said bottom panel;

a side panel foldingly attached to a second perimeter edge of said bottom panel, one of said side and end panels having an adhesive applied thereto;

a bellows panel attached to said one end panel and to said side panel, said bellows panel having first and second bellows sections which are configured to V-fold along a fold line which separates said first bellows sections from said second bellows section, said blank being cut from the piece of material such that a relief area of the piece of material is provided proximate to said bellows panel to form a shoulder between one of said side and end panels and said bellows panel;

said first and second bellows sections v-folding when said side and end panels are folded to an upright position relative to said bottom panel such that said shoulder of said bellows panel allows said second bellows section to be bonded to said adhesive applied to one of said side or end panels, and such that a slot having an opening with no raw or cut edges is formed between said first and second bellows sections;

said separate blank is formed as a top panel having a closure flap with a locking tab on an end of said closure flap, said locking tab configured to, upon formation of said re-closable container, be slidably inserted into said slot such that said locking tab is frictionally secured within said slot.

13. A re-closable container formed from a blank, the blank being cut from a piece of material, said re-closable container comprising:

a bottom panel;

a front panel foldingly attached to said bottom panel, said front panel being upright from said bottom panel;

a rear panel foldingly attached to said bottom panel, said rear panel being upright from said bottom panel;

first and second side panels foldingly attached to said bottom panel, each said side panel having a first adhesive portion applied thereto along an outer edge thereof, each said side panel having a second adhesive portion applied thereto between said first adhesive portion and said bottom panel, said first and second adhesive portions being applied proximate to said front panel, said side panels being upright from said bottom panel;

first and second bellows panels, each said bellows panel having a first bellows section and a second bellows section which are foldingly attached to each other, each said first bellows section being foldingly attached to one of said side panels, each said second bellows section being foldingly attached to said front panel, each said first bellows section being bonded to said first adhesive portion and each said second bellows section being bonded to said second adhesive portion such that a slot having an opening with no raw or cut edges is formed between said first and second bellows sections below said first adhesive portion; and a top panel foldingly attached to said rear panel, said top panel having first and second tab members associated therewith, said first and second tab members configured to be slidably inserted into said slots formed by said first and second bellows sections such that said tab members are frictionally secured within said slots, and such that said top panel effectively closes the container.

14. A re-closable container as defined in claim 13, wherein the piece of material from which the blank used to form the re-closable container was cut has a relief portion provided proximate to said first bellows sections of said bellows panels and said first and second side panels, said relief portions allowing said first bellows sections of said bellows panels to be bonded to said first adhesive portion.

15. A re-closable container as defined in claim 13, wherein said first and second adhesive portions are applied to top surfaces of said first and second side panels.

16. A re-closable container as defined in claim 15, wherein said first and second bellows sections of said first and second bellows panels have top and bottom surfaces.

17. A re-closable container as defined in claim 16, wherein said bottom surface of said first bellows sections are bonded to said first adhesive portions.

18. A re-closable container as defined in claim 17, wherein said bottom surface of said first bellows sections are bonded to the second adhesive portions.

19. A re-closable container as defined in claim 16, wherein said top surface of said second bellows sections are bonded to said second adhesive portions.

20. A re-closable container as defined in claim 13, wherein said tab members associated with said top panel are provided at opposite ends of a closure flap which is foldably attached to said top panel, each of said tab members being foldably attached to said closure flap, said closure flap being positioned along a bottom surface of said front panel.

21. A re-closable container as defined in claim 20, further comprising a pair of internal flaps which are foldably attached to said top panel, each said internal flap being positioned against a top surface of said side panels and against a top surface of said first bellows sections of said bellows panels.

22. A re-closable container formed from a blank, the blank being cut from a piece of material, said re-closable container comprising:

a bottom panel;

a front panel foldingly attached to said bottom panel, said front panel being upright from said bottom panel;

a rear panel foldingly attached to said bottom panel, said rear panel being upright from said bottom panel;

first and second side panels foldingly attached to said bottom panel, said side panels being upright from said bottom panel;

said front panel having a pair of first adhesive portions applied thereto along an outer edge thereof with one of said first adhesive portions being applied proximate to said first side panel and the other one of said first adhesive portions being applied proximate to said second side panel, said front panel having a pair of second adhesive portions applied thereto with one of said second adhesive portions being applied between one of said first adhesive portions and said bottom panel and with the other one of said second adhesive portions being applied between the other one of said first adhesive portions and said bottom panel;

first and second bellows panels, each said bellows panel having a first bellows section and a second bellows section which are foldingly attached to each other, each said first bellows section being foldingly attached to said front panel, each said second bellows section being foldingly attached to one of said side panels, each said first bellows section being bonded to one of said first adhesive portions and each said second bellows section being bonded to one of said second adhesive portions such that a slot having an opening with no raw or cut edges is formed between each of said first and second bellows sections below said first adhesive portions; and a top panel foldingly attached to said rear panel, said top panel having first and second tab members operatively associated therewith, said first and second tab members configured to be slidably inserted into said slots formed by each of said first and second bellows sections such that each said tab member is frictionally secured within one of said slots, and such that said top panel effectively closes the container.

23. A re-closable container as defined in claim 22, wherein the piece of material from which the blank used to form the re-closable container was cut has a relief portion provided proximate to each of said first bellows sections of said bellows panels and said front panel, said relief portions allowing each of said first bellows sections of said bellows panels to be bonded to said first adhesive portions.

24. A re-closable container as defined in claim 22, wherein each of said first and second adhesive portions are applied to top surfaces of said first and second side panels.

25. A re-closable container as defined in claim 24, wherein each of said first and second bellows sections of said first and second bellows panels have top and bottom surfaces.

26. A re-closable container as defined in claim 25, wherein said bottom surface of each of said first bellows sections are bonded to said first adhesive portions.

27. A re-closable container as defined in claim 26, wherein said bottom surface of each of said first bellows sections are bonded to said second adhesive portions.

28. A re-closable container as defined in claim 25, wherein said top surface of each of said second bellows sections are bonded to said second adhesive portions.

29. A re-closable container as defined in claim 22, wherein each of said tab members associated with said top panel are provided on a pair of closure flaps which are foldably attached to said top panel, one of said tab members being foldably attached to one of said closure flaps, the other one of said tab members being foldably attached to the other one of said closure flaps, each of said closure flaps being positioned along a bottom surface of said first and second side panels.

30. A re-closable container as defined in claim 29, further comprising an internal flap which is foldably attached to said top panel, said internal flap being positioned against a top surface of said front panel and against a top surface of each of said first bellows sections of said bellows panels.

31. A two-piece, re-closable container comprising:

a base tray portion formed from a first blank, the first blank being cut from a piece of material, said base tray portion including, a bottom panel;

first and second opposite panels foldingly attached to said bottom panel, said first and second opposite panels being upright from said bottom panel;

third and fourth opposite panels foldingly attached to said bottom panel, said third and fourth opposite panels each having a pair of first adhesive portions applied thereto along an outer edge thereof with one of said first adhesive portions being applied proximate to said first opposite end panel and the other one of said first adhesive portions being applied proximate to said second opposite end panel, said third and fourth opposite panels each having a pair of second adhesive portions applied thereto with each said second adhesive portion being applied between said first adhesive portions and said bottom panel;

first, second, third and fourth bellows panels, each said bellows panel having a first bellows section and a second bellows section which are foldingly attached to each other, each said first bellows section being foldingly attached to one of said third and fourth opposite panels, each said second bellows section being foldingly attached to one of said first and second panels, each said first bellows section being bonded to one of said first adhesive portions and each said second bellows section being bonded to one of said second adhesive portions such that a slot having an opening with no raw or cut edges is formed between each of said first and second bellows sections below said first adhesive portions; and a top panel formed from a second blank, the second blank being cut from a piece of material, said top panel being foldingly attached to first and second closure flaps, each said closure flap having a pair of tab members at opposite ends thereof which are foldingly attached thereto, each said tab member configured to be slidably inserted into one of said slots such that each said tab member is frictionally secured within one of said slots, and such that said top panel effectively closes said base tray portion.

* * * * *